US009506157B2

(12) United States Patent
Funakawa et al.

(10) Patent No.: US 9,506,157 B2
(45) Date of Patent: Nov. 29, 2016

(54) ELECTROLYSIS CELL AND ELECTROLYSIS TANK

(71) Applicant: ASAHI KASEI CHEMICALS CORPORATION, Tokyo (JP)

(72) Inventors: Akiyasu Funakawa, Tokyo (JP); Toshinori Hachiya, Tokyo (JP)

(73) Assignee: ASAHI KASEI KABUSHIKI KAISHA, Tokyo (JP)

( * ) Notice: Subject to any disclaimer, the term of this patent is extended or adjusted under 35 U.S.C. 154(b) by 133 days.

(21) Appl. No.: 14/384,904

(22) PCT Filed: Mar. 18, 2013

(86) PCT No.: PCT/JP2013/057681
§ 371 (c)(1),
(2) Date: Sep. 12, 2014

(87) PCT Pub. No.: WO2013/141211
PCT Pub. Date: Sep. 26, 2013

(65) Prior Publication Data

US 2015/0027878 A1 Jan. 29, 2015

(30) Foreign Application Priority Data

Mar. 19, 2012 (JP) ..... 2012-062324
Mar. 28, 2012 (JP) ..... 2012-074657

(51) Int. Cl.
*C25B 1/46* (2006.01)
*C25B 9/08* (2006.01)
*C25B 11/04* (2006.01)

(52) U.S. Cl.
CPC . *C25B 9/08* (2013.01); *C25B 1/46* (2013.01); *C25B 11/04* (2013.01)

(58) Field of Classification Search
None
See application file for complete search history.

(56) References Cited

U.S. PATENT DOCUMENTS

2006/0042935 A1 3/2006 Houda et al.
2006/0070874 A1* 4/2006 Nara ..... C25B 11/0494 204/292
2011/0198230 A1 8/2011 Tanaka et al.

(Continued)

FOREIGN PATENT DOCUMENTS

CN 1050229 3/1991
CN 101220482 7/2008

(Continued)

OTHER PUBLICATIONS

Supplementary European Search Report, mail date is Feb. 2, 2015.

(Continued)

*Primary Examiner* — Harry D Wilkins, III
(74) *Attorney, Agent, or Firm* — Greenblum & Bernstein, P.L.C.

(57) ABSTRACT

Provided is an electrolysis cell capable of suppressing the degradation of a cathode by the reverse current at the time of stopping electrolysis. According to an aspect of the invention, there is provided an electrolysis cell comprising an anode chamber, a cathode chamber, a partition wall separating the anode chamber from the cathode chamber, an anode installed in the anode chamber, a cathode installed in the cathode chamber, and a reverse current absorbing body having a substrate and a reverse current absorbing layer formed on the substrate and installed in the cathode chamber, in which the anode and the cathode are electrically connected and the cathode and the reverse current absorbing layer are electrically connected.

54 Claims, 9 Drawing Sheets

(56) References Cited

U.S. PATENT DOCUMENTS

| | | | | |
|---|---|---|---|---|
| 2012/0241314 | A1 | 9/2012 | Madono et al. | |
| 2012/0279853 | A1* | 11/2012 | Funakawa | C25B 1/04 204/242 |

FOREIGN PATENT DOCUMENTS

| | | |
|---|---|---|
| JP | 3-166393 | 7/1991 |
| JP | 2010-111947 | 5/2010 |
| JP | 4846869 | 12/2011 |
| TW | 200409834 | 6/2004 |
| WO | 2004/048643 | 6/2004 |
| WO | 2010/061766 | 6/2010 |
| WO | 2012/032793 | 3/2012 |

OTHER PUBLICATIONS

Search report from International Patent Appl. No. PCT/JP2013/057681, mail date is Apr. 23, 2013.

International Preliminary Report on Patentability, mail date is Oct. 2, 2014.

* cited by examiner

ELECTROLYSIS CELL AND ELECTROLYSIS TANK

TECHNICAL FIELD

The present invention relates to an electrolysis cell for the electrolysis of an alkali salt, the water electrolysis, and a fuel cell, and an electrolysis tank.

BACKGROUND ART

An ion exchange membrane method using an electrolysis tank equipped with an ion exchange membrane is mainly used in the electrolytic decomposition (hereinafter, referred to as the "electrolysis") of an aqueous solution of alkali metal chloride such as brine. This electrolysis tank is equipped with a large number of electrolysis cells connected in series therein. Electrolysis is performed by interposing an ion exchange membrane between the respective electrolysis cells. A cathode chamber having a cathode and an anode chamber having an anode are disposed back to back via a partition wall (rear plate) in the electrolysis cell. As an electrolysis tank, an electrolysis tank described in Patent Literature 1 or the like is known.

In recent years, the facility of an electrolysis tank has been increased in size, and the number of electrolysis cells arranged in series has increased to from about 100 to 200 pairs. Along with it, the reverse current (current flowing in the direction opposite to the electrolytic current) generated at the time of stopping has increased, and thus the degradation due to the oxidation of the cathode easily occurs.

In order to prevent the degradation of the cathode, a measure in which a weak protection current is applied before stopping the electrolysis tank has been adopted. However, there is a problem that the cost of electrolysis increases since the operation is complicated and incidental facilities are required in this electrolysis stopping method of applying the protection current. These are points to be desirably improved from an economic point of view. For this reason, a method to prevent the degradation of the cathode without applying the protection current at the time of stopping the electrolysis tank is desirable.

As a technique to prevent the degradation of the cathode by the reverse current, it is disclosed in Patent Literature 2 a cathode structure for electrolysis in which Raney nickel is formed on the surface of a current collector by dispersion plating.

CITATION LIST

Patent Literature

Patent Literature 1: WO 2004/048643 A
Patent Literature 2: JP 4846869 B1

SUMMARY OF INVENTION

Technical Problem

However, there is also a case in which Raney nickel peels off during the electrolysis since Raney nickel attached on the current collector by the dispersion plating is weak in adhesion with the current collector. There is also a case in which Raney nickel at the part in contact with an elastic body physically peels off when the elastic body electrically connecting the current collector and the cathode is interposed. In addition, there is a possibility that heat generation or firing occurs when Raney nickel in the open cathode structure is exposed to the air after stopping the electrolysis tank in some cases if Raney nickel having a too large specific surface area after the alkali development treatment is used, and thus careful handling is required. Moreover, the technique described in Patent Literature 2 cannot be adopted to an electrolysis tank having an electrode structure originally having no current collector.

Accordingly, an object of the invention is to provide an electrolysis cell capable of suppressing the degradation of the cathode by the reverse current at the time of stopping electrolysis and exhibiting high durability, and an electrolysis tank.

Solution to Problem

The present inventors have conducted intensive investigations to solve the above problems. As a result, it have been found out that the degradation of a cathode by the reverse current can be significantly suppressed by electrically connecting the cathode and a reverse current absorbing layer which is more easily oxidized than the cathode in an electrolysis cell, thereby achieving the invention. In other words, the invention is as follows.

The invention provides an electrolysis cell including an anode chamber, a cathode chamber, a partition wall separating the anode chamber from the cathode chamber, an anode installed in the anode chamber, a cathode installed in the cathode chamber, and a reverse current absorbing body having a substrate and a reverse current absorbing layer formed on the substrate and installed in the cathode chamber, in which the anode and the cathode are electrically connected and the cathode and the reverse current absorbing layer are electrically connected. In addition, the invention provides an electrolysis tank equipped with the electrolysis cell.

It is preferable that a reverse current absorbing layer contain an element having an oxidation-reduction potential lower than a cathode (an element having a less noble oxidation-reduction potential).

It is preferable that a reverse current absorbing layer contain one or more kinds of elements selected from the group consisting of C, Cr, Ni, Ti, Fe, Co, Cu, Al, Zr, Ru, Rh, Pd, Ag, W, Re, Os, Ir, Pt, Au, Bi, Cd, Hg, Mn, Mo, Sn, Zn, La, Ce, Pr, Nd, Pm, Sm, Eu, Gd, Tb, Dy, Ho, Er, Tm, Yb, and Lu.

It is preferable that a reverse current absorbing layer be a porous layer containing Ni or NiO, and a full width at half maximum of a diffraction line peak of Ni metal at a diffraction angle $2\theta=44.5°$ in a powder X-ray diffraction pattern of the reverse current absorbing layer is 0.6° or less.

It is preferable that a pore volume of a pore having a pore size of 10 nm or greater be 80% or more of a total pore volume in a pore size distribution curve measured by a nitrogen gas adsorption method in a reverse current absorbing layer.

It is preferable that a reverse current absorbing layer be formed by thermal spraying Ni or NiO on at least a part of a surface of a substrate.

It is more preferable that a reverse current absorbing layer is formed by thermal spraying NiO on at least a part of a surface of a substrate and then performing a reduction treatment to the NiO.

It is preferable that a cathode have a Ni substrate and a catalytic layer formed on the Ni substrate.

In a first aspect of the invention, it is preferable that a cathode chamber further have a current collector, a support supporting the current collector, and a metal elastic body, the metal elastic body is disposed between the current collector and a cathode, the support is disposed between the current collector and a partition wall, and the partition wall, the support, the current collector, the metal elastic body, and the cathode are electrically connected.

In the first aspect of the invention described above, at least a part of a substrate of a reverse current absorbing body may be the current collector, and a reverse current absorbing layer may be formed on a surface of the current collector.

In the first aspect of the invention described above, at least a part of the substrate of the reverse current absorbing body may be the metal elastic body, and the reverse current absorbing layer may be formed on a surface of the metal elastic body.

In the first aspect of the invention described above, at least a part of the substrate of the reverse current absorbing body may be the partition wall, and the reverse current absorbing layer may be formed on a surface of the partition wall.

In the first aspect of the invention described above, at least a part of the substrate of the reverse current absorbing body may be the support, and the reverse current absorbing layer may be formed on a surface of the support.

In the first aspect of the invention described above, at least a part of the reverse current absorbing body may be disposed between the cathode and the metal elastic body.

In the first aspect of the invention described above, at least a part of the reverse current absorbing body may be disposed between the metal elastic body and the current collector.

In the first aspect of the invention described above, at least a part of the reverse current absorbing body may be disposed between the current collector and the partition wall.

In a second aspect of the invention, it is preferable that a cathode chamber further have a support supporting a cathode, the support be disposed between the cathode and a partition wall, and the partition wall, the support, and the cathode be electrically connected.

In the second aspect of the invention described above, at least a part of a substrate of a reverse current absorbing body may be the partition wall, and a reverse current absorbing layer may be formed on a surface of the partition wall.

In the second aspect of the invention described above, at least a part of the substrate of the reverse current absorbing body may be the support, and the reverse current absorbing layer may be formed on a surface of the support.

In the second aspect of the invention described above, the reverse current absorbing body may be disposed between the cathode and the partition wall.

At least a part of a substrate of a reverse current absorbing body may be a cube, a cuboid, a plate-like shape, a rod-like shape, a reticular shape, or a spherical shape.

It is preferable that a specific surface area of a reverse current absorbing layer be from 0.01 to 100 $m^2/g$.

It is preferable that a sum of electric quantities absorbed by all of reverse current absorbing bodies be from 1,000 to 2,000,000 $C/m^2$.

It is preferable that a sum of effective surface areas of all of the reverse current absorbing bodies be from 10 to 100,000 $m^2$.

Advantageous Effects of Invention

According to the invention, an electrolysis cell capable of suppressing the degradation of a cathode by the reverse current at the time of stopping electrolysis and an electrolysis tank are provided.

DESCRIPTION OF EMBODIMENTS

Figure 1:
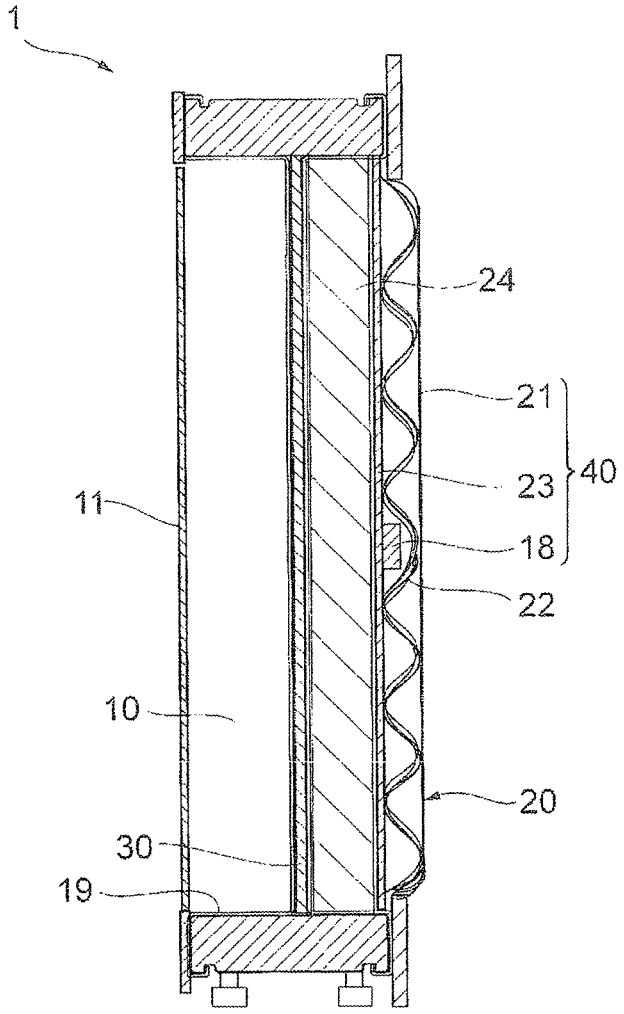
FIG. 1 is a schematic cross-sectional view of an electrolysis cell according to a first embodiment of the invention.

Hereinafter, embodiments of the invention will be described in detail with reference to the accompanying drawings if necessary. The following embodiments are examples for describing the invention, and the invention is not limited to the following contents. In addition, the accompanying drawings are intended only to show examples of the embodiments, and the embodiments are not intended to be construed as being limited thereto. The invention can be appropriately modified and carried out within the scope of the invention. Meanwhile, unless otherwise specified, the positional relationships of right and left and top and bottom in the drawing are based on the positional relationships shown in the drawings. The dimensions and proportions of the drawings are not limited to those illustrated.

First Embodiment

Figure 5:
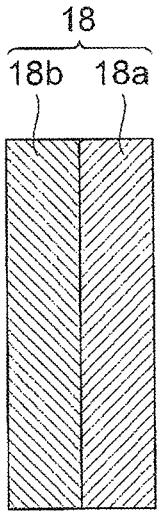
FIG. 5 is a schematic cross-sectional view of a reverse current absorbing body equipped in an electrolysis cell according to a first embodiment of the invention.

FIG. 1 is a cross-sectional view of an electrolysis cell 1 of a first embodiment of the invention. The electrolysis cell 1 is equipped with an anode chamber 10, a cathode chamber 20, a partition wall 30 installed between the anode chamber 10 and the cathode chamber 20, an anode 11 installed in the anode chamber 10, a cathode 21 installed in the cathode chamber 20, a reverse current absorbing body 18 having a substrate 18*a* and a reverse current absorbing layer 18*b* formed on the substrate 18*a* and installed in the cathode chamber. The anode 11 and the cathode 21 belonging to one electrolysis cell 1 are electrically connected. In other words, the electrolysis cell 1 is equipped with the following cathode structure. A cathode structure 40 is equipped with the cathode chamber 20, the cathode 21 installed in the cathode chamber 20, and the reverse current absorbing body 18 installed in the cathode chamber 20, and the reverse current absorbing body 18 has the substrate 18*a* and the reverse current absorbing layer 18*b* formed on the substrate 18*a* as illustrated in FIG. 5 and the cathode 21 and the reverse current absorbing layer 18*b* are electrically connected. The cathode chamber 20 further has a current collector 23, a support 24 supporting the current collector, and a metal elastic body 22. The metal elastic body 22 is disposed between the current collector 23 and the cathode 21. The support 24 is disposed between the current collector 23 and the partition wall 30. The current collector 23 is electrically connected with the cathode 21 via the metal elastic body 22. The partition wall 30 is electrically connected with the current collector 23 via the support 24. Hence, the partition wall 30, the support 24, the current collector 23, the metal elastic body 22, and the cathode 21 are electrically connected. The cathode 21 and the reverse current absorbing layer 18*b* are electrically connected. The cathode 21 and the reverse current absorbing layer may be directly connected or indirectly connected via the current collector, the support, the metal elastic body, the partition wall, or the like. The entire surface of the cathode 21 is preferably coated with a catalytic layer for the reduction reaction. In addition, the form of electrical connection may be a form in which the partition wall 30 and the support 24, the support 24 and the current collector 23, and the current collector 23 and the metal elastic body 22 are directly attached to each other, respectively, and the cathode 21 is laminated on the metal elastic body 22. As a method of attaching these respective constructional members directly to each other, welding or the like may be exemplified. In addition, the reverse current absorbing body 18, the cathode 21, and the current collector 23 may be collectively called as the cathode structure 40.

Figure 2:
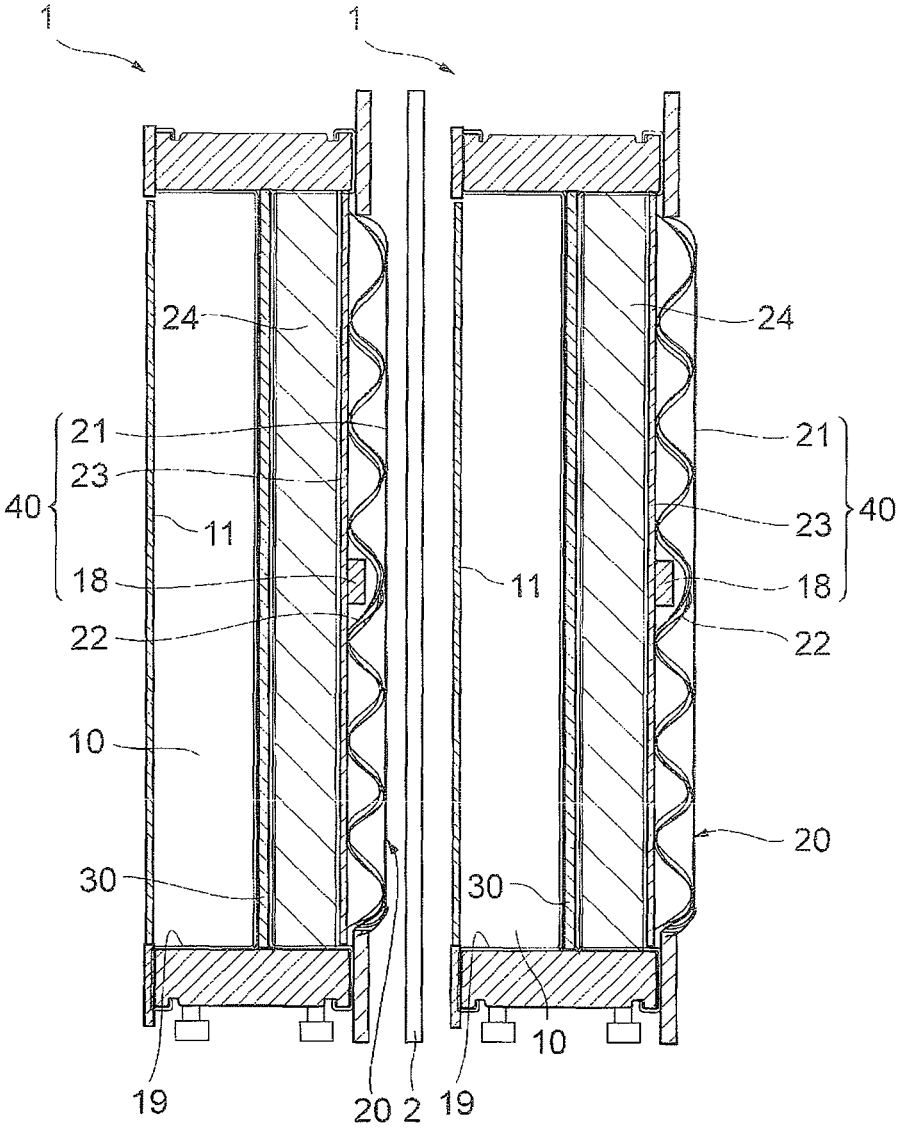
FIG. 2 is a schematic cross-sectional view illustrating a state in which two electrolysis cells according to a first embodiment are connected in series.
Figure 3:
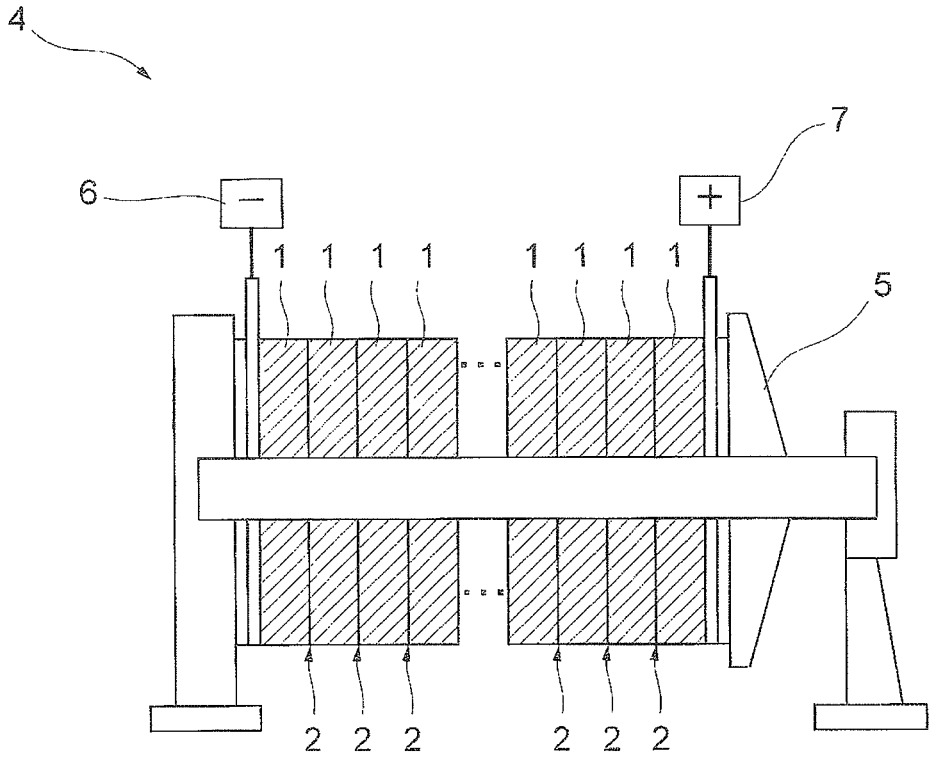
FIG. 3 is a schematic diagram of an electrolysis tank according to a first embodiment of the invention.
Figure 4:
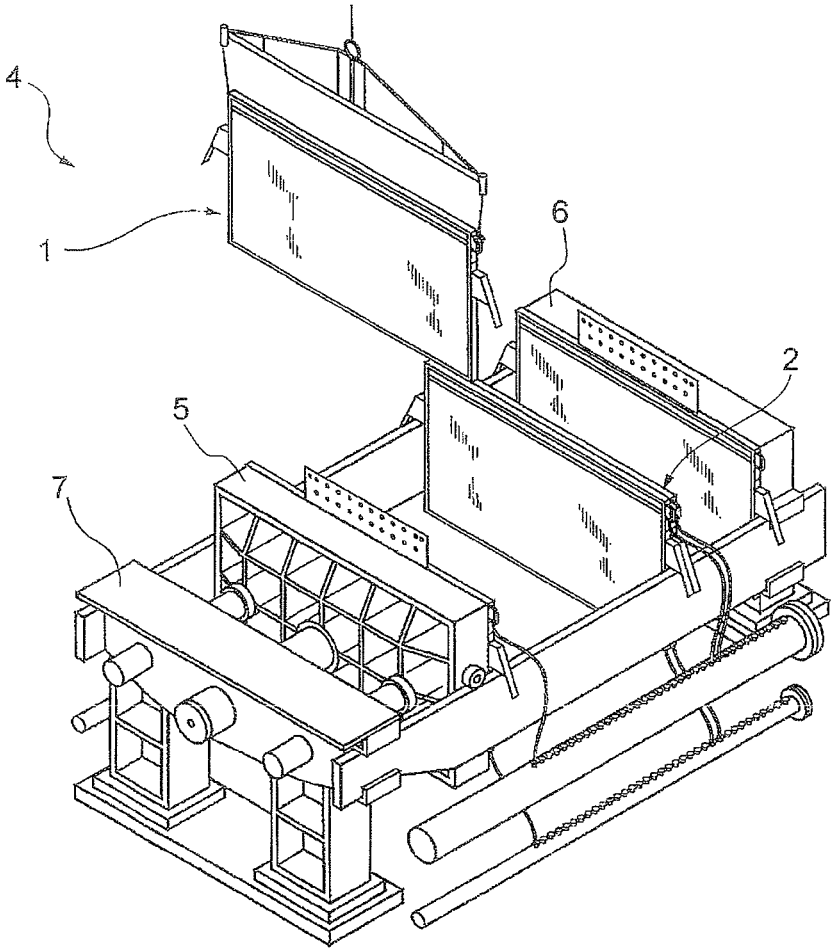
FIG. 4 is a schematic perspective view illustrating a process of assembling an electrolysis tank of a first embodiment or a second embodiment.

FIG. 2 is a cross-sectional view of two adjacent electrolysis cells 1 in an electrolysis tank 4 of the present embodiment. FIG. 3 illustrates the electrolysis tank 4. FIG. 4 illustrates the process of assembling the electrolysis tank 4. As illustrated in FIG. 2, the electrolysis cell 1, a cation exchange membrane 2, the electrolysis cell 1 are arranged in series in this order. The ion exchange membrane 2 is disposed between the anode chamber of one electrolysis cell 1 of the two adjacent electrolysis cells in the electrolysis tank and the cathode chamber of the other electrolysis cell 1 thereof. In other words, the anode chamber 10 of one electrolysis cell 1 is separated from the cathode chamber 20 of the other electrolysis cell 1 adjacent to this by the cation exchange membrane 2. As illustrated in FIG. 3, the electrolysis tank 4 is constituted with plural electrolysis cells 1 connected in series via the ion exchange membrane 2. In other words, the electrolysis tank 4 is a bipolar type electrolysis tank equipped with the plural electrolysis cells 1 disposed in series and the ion exchange membrane 2 disposed between the adjacent electrolysis cells 1. As illustrated in FIG. 4, the electrolysis tank 4 is assembled by disposing the plural electrolysis cells 1 in series via the ion exchange membrane 2 and connecting them by a press machine 5.

The electrolysis tank 4 has an anode terminal 7 and a cathode terminal 6 connected to a power supply. The anode 11 of the electrolysis cell 1 positioned at the end among the plural electrolysis cells 1 connected in series in the electrolysis tank 4 is electrically connected to the anode terminal 7. The cathode 21 of the electrolysis cell positioned at the end opposite to the anode terminal 7 among the plural electrolysis cells 2 connected in series in the electrolysis tank 4 is electrically connected to the cathode terminal 6. The current at the time of electrolysis flows from the anode terminal 7 side toward the cathode terminal 6 through the anode and cathode of each electrolysis cell 1. Meanwhile, an electrolysis cell having only an anode chamber (anode terminal cell) and an electrolysis cell having only a cathode chamber (cathode terminal cell) may be disposed at both ends of the connected electrolysis cells 1. In this case, the anode terminal 7 is connected to the anode terminal cell disposed at one end thereof and the cathode terminal 6 is connected to the cathode terminal cell disposed at the other end thereof.

In a case in which the electrolysis of salt water is performed, the salt water is supplied to each anode chamber 10, and pure water or an aqueous solution of sodium hydroxide having a low concentration is supplied to the cathode chamber 20. Each liquid is supplied from an electrolyte supply tube (omitted in the drawing) to each electrolysis cell 1 through an electrolyte supply hose (omitted in the drawing). In addition, the electrolyte and a product of the electrolysis are recovered by an electrolyte recovery tube (omitted in the drawing). In the electrolysis, sodium ions in the salt water move from the anode chamber 10 of one electrolysis cell 1 to the cathode chamber 20 of the adjacent electrolysis cell 1 through the ion exchange membrane 2. Hence, the current during the electrolysis flows along the direction in which the electrolysis cells 1 are connected in series. In other words, the current flows from the anode chamber 10 toward the cathode chamber 20 via the cation exchange membrane 2. Along with the electrolysis of salt water, chlorine gas is generated at the anode 11 side, and sodium hydroxide (solute) and hydrogen gas are generated in the cathode 21 side.

The reverse current is generated by a voltage (electric potential difference) between the electrolysis cell 1 and the grounded electrolyte supply tube or electrolyte recovery tube at the time of stopping the electrolysis. The reverse current flows to the electrolyte supply tube or the electrolyte recovery tube via the electrolyte supply hose. The reverse current flows in a direction opposite to the direction of the current at the time of the electrolysis.

This reverse current is generated due to the state in which a battery having chlorine as reactive species is formed at the time of stopping the electrolysis. Chlorine generated at the anode chamber 10 side is dissolved in the electrolyte (brine or the like) in the anode chamber 10 at the time of electrolysis. Then, a reaction in which chlorine is decomposed in the anode 11 occurs at the time of stopping the electrolysis since the reactivity of chlorine dissolved in this anode chamber 10 is high. Consequently, a voltage is generated between the electrolysis cell 1 and the grounded electrolyte supply tube or electrolyte recovery tube at the time of stopping the electrolysis and thus the reverse current flows.

Moreover, hydrogen is generated in the cathode 21, and chlorine is generated in the anode 11 at the time of electrolysis, but the amount of chlorine dissolved in the anode chamber 10 is incomparably greater compared to the amount of hydrogen dissolved in the cathode chamber 20. For this reason, the reverse current (oxidation current) is not completely consumed by only the reverse reaction of the hydrogen evolution reaction in the cathode 21 and thus the cathode 21 itself consumes the reverse current (oxidation current), for example, in a case in which there is no reverse current absorbing layer 18*b*. Consequently, the degradation of the cathode 21 (oxidation of the cathode 21, and dissolution or oxidation of the catalytic layer) by the reverse current occurs in a case in which the electrolysis is stopped in a state where a large amount of dissolved chlorine is contained in the anode chamber 10. The catalytic layer of the cathode is dissolved by the reverse current generated at the time of stopping the electrolysis, for example, in a case in which a catalyst material dissolvable by the reverse current such as Ru or Sn is used as a catalytic layer of the cathode, and thus the catalyst amount of the cathode 21 decreases, as a result, the lifetime of the cathode 21 is significantly shortened.

On the other hand, the oxidation of the catalytic component by the reverse current generated at the time of stopping the electrolysis and an oxygen evolution reaction in the cathode 21 side occur in a case in which a catalyst material not dissolvable by the reverse current such as Ni or Pt is used as a catalytic layer of the cathode. In addition, a mixed gas of hydrogen and oxygen is generated in the cathode chamber 20 in a case in which the reverse current is great. Moreover, the catalytic layer of the cathode is easily deteriorated by the oxidation due to electrolysis stopping and the reduction due to re-energization, and thus the lifetime of the cathode 21 is shortened.

<Mechanism>

The mechanism in which the degradation of the cathode is suppressed by the consumption of the reverse current in the reverse current absorbing body 18 will be described. The electric potential of the cathode is maintained at about −1.2 V (vs. Ag|AgCl reference electrode) while the hydrogen evolution reaction proceeds in the electrolysis of salt. However, the electric potential increases while the oxidation reaction proceeds on the cathode when the electrolysis is stopped and the reverse current flows to the cathode, and the electric potential of the cathode finally reaches the oxygen evolution potential.

Various oxidation reactions of the substances having an oxidation-reduction potential less noble than the oxygen evolution potential of the cathode preferentially proceed on the cathode during the period of time from when the electrolysis is stopped to when the electric potential of the cathode reaches the oxygen evolution potential. As a matter of course, the oxidation reaction of the component contained in the catalytic layer (coating) of the cathode also proceeds. The oxidation of the component contained in the coating of the cathode adversely affects the coating of the cathode such as the decreases in performance and durability of the cathode.

However, in the first embodiment, a reverse current absorbing layer having an oxidation-reduction potential less noble than the component contained in the catalytic layer of the cathode is electrically connected to the cathode. For that reason, the reverse current generated at the time of stopping the electrolysis is not consumed in the cathode but consumed in the reverse current absorbing layer electrically connected to the cathode. In other words, the reverse current absorbing layer absorbs the reverse current and the oxidation reaction of the reverse current absorbing layer corresponding to the electric quantity of the reverse current proceeds. As a result, the oxidation and degradation of the catalytic layer of the cathode 21 by the reverse current are suppressed. In addition, it is also possible to prevent the decreases in performance and durability of the catalytic layer of the cathode by the impurities (particularly Fe ion) contained in the cathode liquid by the use of the reverse current absorbing body. The reason for this is presumed as follows. The specific surface area of the reverse current absorbing layer is great and the electrolytic reduction reaction of Fe ions in the reverse current absorbing layer more easily occurs than the reaction in the catalytic layer of the cathode.

<Mechanism in the Case of Using Ru Cathode>

The electric potential increases while an oxidation reaction proceeds on the cathode when the reverse current flows after stopping the electrolysis and the electric potential of the cathode finally reaches the oxygen evolution potential in a case in which a Ni substrate having a surface coated with a catalytic layer containing Ru is used in the cathode. Various oxidation reactions of the substances having an oxidation-reduction potential less noble than the oxygen evolution potential preferentially proceed on the cathode in the order of being less noble in the oxidation-reduction potential during the period of time from when the electrolysis is stopped to when the electric potential of the cathode reaches the oxygen evolution potential. Specifically, the oxidation reaction (1) of hydrogen adsorbed to the cathode proceeds at about −1.0 V (vs. Ag|AgCl) first. Next, the oxidation reaction (2) of Ni metal (surface of Ni substrate) proceeds at about −0.9 V (vs. Ag|AgCl). Next, the oxidative dissolution reaction (3) of Ru which is a component of the catalytic layer proceeds at about −0.1 V (vs. Ag|AgCl). Next, the oxidation reaction (4) of nickel hydroxide generated in the reaction (2) proceeds at about +0.2 V (vs. Ag|AgCl) to generate trivalent to tetravalent Ni. Finally, the oxygen evolution reaction (5) proceeds at about +0.3 V (vs. Ag|AgCl).

$$H+OH^- \rightarrow H_2O+e^- \quad \text{Reaction (1)}$$

$$Ni+2OH^- \rightarrow Ni(OH)_2+2e^- \quad \text{Reaction (2)}$$

$$RuO_xH_y+aOH^- \rightarrow RuO_4^{2-}+bH_7O+ce^- \quad \text{Reaction (3)}$$

$$Ni(OH)_2+OH^- \rightarrow NiOOH+H_2O+e^- \quad \text{Reaction (4)}$$

$$4OH^- \rightarrow O_2+2H_7O+4e^- \quad \text{Reaction (5)}$$

The cathode potential is maintained at about −1.0 V vs. Ag|AgCl while the reaction (1) is in progress, and the cathode potential starts to rise when the reaction (1) is completed and reaches the electric potential for the subsequent reaction (2). The cathode potential is maintained at the electric potential for the reaction (2) (−0.9 V vs. Ag|AgCl) until the reaction (2) is completed. The cathode potential starts to rise again when the reaction (2) is completed and reaches the electric potential for the subsequent reaction (3) (−0.1 V vs. Ag|AgCl). The cathode potential starts to rise again when the reaction (3) is completed and reaches the electric potential for the subsequent reaction (4) (+0.2 V vs. Ag|AgCl). The cathode potential starts to rise again when the reaction (4) is completed and reaches the electric potential for the subsequent reaction (5) (+0.3 V vs. Ag|AgCl).

In this manner, the oxidative dissolution reaction (3) of Ru which is a component of the catalytic layer does not start immediately when the reverse current flows but starts after the oxidation reactions (1) and (2) of the substance less noble than the oxidation-reduction potential are completed. In other words, the oxidative dissolution reaction (3) of Ru of the catalytic layer can be suppressed by increasing the electric quantity consumed by the oxidation reactions of hydrogen and nickel having an oxidation-reduction potential less noble than Ru of the catalytic layer than the electric quantity of the reverse current.

Here, the oxidation reaction (6) (the same reaction as the reaction (2)) of Ni of the reverse current absorbing layer proceeds when a reverse current absorbing body equipped with a reverse current absorbing layer containing Ni is introduced into the cathode chamber and electrically connected with the cathode, and the electric potential of the cathode (catalytic layer) does not rise to or higher than the electric potential of the reverse current absorbing layer when the electric quantity consumed by the reaction (6) is greater than the electric quantity of the reverse current. This is because the cathode and the reverse current absorbing body are electrically connected and thus the electric potentials thereof are constantly the same. As a result, the oxidative dissolution reaction (3) of Ru of the catalytic layer can be suppressed since the oxidation reaction (6) of Ni of the reverse current absorbing layer proceeds preferentially to the dissolution reaction (3) of Ru.

(Catalytic Layer)

Above, a case in which the catalytic layer of the cathode is constituted with Ru has been described, but an element other than Ru may be used in the catalytic layer. Examples of the element for the catalytic layer may include C, Si, P, S, Al, Ti, V, Cr, Mn, Fe, Co, Ni, Cu, Zn, Y, Zr, Nb, Mo, Rh, Pd, Ag, Cd, In, Sn, Ta, W, Re, Os, Ir, Pt, Au, Hg, Pb, Bi, La, Ce, Pr, Nd, Pm, Sm, Eu, Gd, Tb, Dy, Ho, Er, Tm, Yb, and Lu. It is possible to obtain the same effect as in the case of Ru by selecting a material having an oxidation-reduction potential less noble than the oxidation-reduction potential of these elements as the material of the reverse current absorbing layer. An oxidation reaction proceeds when the cathode potential rises in a case in which the above elements other than Ru is used in the catalytic layer as well, and thus a decrease in performance occurs. In addition, the reactions (1), (2), (4), and (5) described above proceed. The trivalent to tetravalent nickel compound generated particularly in the reaction (4) among these reactions has a needle-like, hexagonal, or hexagonal pillar stage structure and is generated at the interface of the catalytic layer and the cathode substrate. As a result, peeling from the cathode of the catalytic layer occurs which leads to the decreases in performance and durability of the catalytic layer. Here, it is possible to maintain the cathode potential at the electric potential less noble than the oxidation-reduction potential of the element contained in the catalytic layer of the cathode or the electric potential of the reaction (4) by the same principle as described above by using a reverse current absorbing body having a reverse current absorbing layer constituted with Ni, and thus the oxidation of the catalytic layer and the generation of the trivalent to tetravalent nickel compound in the cathode can be suppressed and the performance and durability of the catalytic layer can be maintained.

(Cathode)

The cathode 21 is provided in the frame of the cathode chamber 20. The cathode 21 preferably has a nickel substrate and a catalytic layer coating the nickel substrate. Examples of the component of the catalytic layer on the nickel substrate may include a metal such as C, Si, P, S, Al, Ti, V, Cr, Mn, Fe, Co, Ni, Cu, Zn, Y, Zr, Nb, Mo, Rh, Pd, Ag, Cd, In, Sn, Ta, W, Re, Os, Ir, Pt, Au, Hg, Pb, Bi, La, Ce, Pr, Nd, Pm, Sm, Eu, Gd, Tb, Dy, Ho, Er, Tm, Yb, and Lu and an oxide or a hydroxide of the metals. Examples of the method of forming the catalytic layer may include plating, alloy plating, dispersion and composite plating, CVD, PVD, thermal decomposition, and thermal spraying. These methods may be combined. In addition, the cathode 21 may be subjected to a reduction treatment if necessary. Meanwhile, a nickel alloy may be used as the substrate of the cathode 21 other than the nickel substrate.

(Reverse Current Absorbing Layer)

The reverse current absorbing layer 18*b* preferably contains an element having an oxidation-reduction potential less noble (low oxidation-reduction potential) compared to the cathode. In other words, the oxidation-reduction potential of the oxidation reaction of the reverse current absorbing layer 18*b* is preferably less noble compared to the oxidation-reduction potential of the oxidation reaction of the catalytic layer coating the surface of the cathode 21.

Examples of the material of the reverse current absorbing layer 18*b* may include an inorganic substance such as a metal material or an oxide material having a high specific surface area, and a carbon material having a high specific surface area.

As the material having a high specific surface area, a material having an oxidation-reduction potential less noble than the oxidation-reduction potential of the component contained in the catalytic layer (coating) of the cathode 21 is preferable. Examples of such a material may include C, Cr, Ni, Ti, Fe, Co, Cu, Al, Zr, Ru, Rh, Pd, Ag, W, Re, Os, Ir, Pt, Au, Bi, Cd, Hg, Mn, Mo, Sn, Zn, La, Ce, Pr, Nd, Pm, Sm, Eu, Gd, Tb, Dy, Ho, Er, Tm, Yb, and Lu. As the material constituting the reverse current absorbing layer 18*b*, Ni, Mn, Cr, Fe, Co, Re, La, Ce, Pr, Nd, Pm, Sm, Eu, Gd, Tb, Dy, Ho, Er, Tm, Yb, or Lu which has an oxidation-reduction potential less noble than Ru can be used, for example, in a case in which Ru is contained in the catalytic layer of the cathode 21. The electric quantity of the reverse current is absorbed by the reaction forming a hydroxide or an oxide from the above element contained in the reverse current absorbing layer 18*b*, and thus the oxidation of the cathode is suppressed. It is possible to obtain the effect of absorbing the reverse current can be obtained even in a case in which a mixture, an alloy, or a composite oxide of the elements described above is used as a reverse current absorbing layer 18*b*. Ni, Mn, Cr, Fe, Co, Re, La, Ce, Pr, Nd, Pm, Sm, Eu, Gd, Tb, Dy, Ho, Er, Tm, Yb, or Lu which has an oxidation-reduction potential less noble than Pt can be used as the metal material constituting the reverse current absorbing layer 18*b* in a case in which Pt is contained in the catalytic layer of the cathode 21.

Examples of the carbon material having a high specific surface area may include activated carbon, activated carbon fibers, carbon black, graphite, carbon fibers, carbon nanotubes, and mesoporous carbon. The carbon material having a high specific surface area can function as a capacitor for storing the electric quantity of the reverse current.

As the material of the reverse current absorbing layer 18*b*, an organic substance such as a conductive polymer may be used. Examples of the conductive polymer may include polyaniline, 1,5-diaminoanthraquinone, a cyclic indole trimer, and poly (3-methylthiophene).

The materials of the reverse current absorbing layer 18*b* described above can also be used in combination.

Among the materials of the reverse current absorbing layer 18*b* described above, the metal material having a high specific surface area and an oxide material are preferable and nickel having a high specific surface area is more preferable from the viewpoint of long-term durability.

The reverse current absorbing layer 18*b* is more preferably a porous layer containing Ni or NiO. The full width at half maximum of the diffraction line peak of nickel metal at the diffraction angle $2\theta=44.5°$ in the powder X-ray diffraction pattern of the reverse current absorbing layer 18*b* may be 0.6° or less.

The crystallinity of the reverse current absorbing layer increases when the full width at half maximum is 0.6° or less, and thus the physical durability and the chemical durability increase. High physical durability means that the reverse current absorbing layer is strengthened as nickel metal is present as a backbone and thus the reverse current absorbing layer hardly peels off from the current collector although physical force (for example, pressure due to the metal elastic body) is applied thereto. In addition, high chemical durability means that the inside of the nickel metal present in the reverse current absorbing layer as a backbone is not subject to an oxidation or a reduction. Nickel metal can be stably present while maintaining the backbone structure during the electrolysis and the reverse electrolysis due to the high chemical durability since the reverse electrochemical reaction is a surface reaction. The full width at half maximum described above is more preferably 0.5° or less and particularly preferably 0.38° or less. Although the lower limit of the full width at half maximum is not particularly limited, for example, the full width at half maximum is 0.01° or more, preferably 0.1° or more, and more preferably 0.2° or more.

The feature of the reverse current absorbing layer 18*b* is exhibited when the layer is a porous layer containing Ni or NiO as a main component and the full width at half maximum of the diffraction line peak of nickel metal at the diffraction angle 2θ=44.5° in the powder X-ray diffraction pattern thereof is 0.6° or less, but the reverse current absorbing layer 18*b* may further contain the following components as long as these features are maintained and the effect of the invention is not impaired.

Elements other than Ni, for example, C, Cr, Al, Zr, Ru, Rh, Ag, Re, Os, Ir, Pt, Au, Bi, Cd, Co, Cu, Fe, Hg, Mn, Mo, Pd, Sn, Ti, W, Zn, La, Ce, Pr, Nd, Pm, Sm, Eu, Gd, Tb, Dy, Ho, Er, Tm, Yb, and Lu are also capable of absorbing the reverse current through a reaction to form a hydroxide or an oxide thereof. Consequently, the reverse current absorbing layer may contain these elements or a mixture, an alloy, or a composite oxide thereof in addition to Ni or NiO. The proportion of Ni to the total elements contained in the reverse current absorbing layer 18*b* is 10% by mole or more and 100% by mole or less in a case in which an element other than Ni is contained. The proportion is more preferably 30% by mole or more and 100% by mole or less and still more preferably 50% by mole or more and 100% by mole or less.

In addition, the reverse current absorbing layer 18*b* is preferably formed by thermal spraying Ni or NiO on at least a part of the surface of the current collector. In addition, the reverse current absorbing layer 18*b* is preferably formed by thermal spraying NiO and then performing a reduction treatment to the NiO in a case in which NiO is thermal sprayed. By virtue of this, it is possible to increase the quantity of the reverse current absorbed by the reverse current absorbing layer from the initial stage of the electrolysis can be increased. Moreover, the durability of the reverse current absorbing layer 18*b* also further increases.

In addition, in the reverse current absorbing layer 18*b*, the pore volume of the pores having a pore size 10 nm or greater is preferably 80% or more, more preferably 85% or more, and still more preferably 90% or more of the total pore volume in the pore size distribution curve measured by the nitrogen gas adsorption method. By virtue of this, there is no risk of heat generation or firing when the electrolysis tank is stopped and the reverse current absorbing layer 18*b* is exposed to the air, and thus it is possible to handle safely.

<Specific Surface Area, Pore Size Distribution Curve, and Pore Volume>

The specific surface area, pore size distribution curve, and pore volume of the reverse current absorbing layer can be obtained as follows. The sample for measurement is introduced into a dedicated cell and subjected to heat evacuation to perform the pretreatment, thereby removing the adsorbate on the pore surface. Thereafter, the adsorption and desorption isotherm of nitrogen adsorption to the sample for measurement is measured at −196° C. The specific surface area of the sample for measurement can be determined by analyzing the adsorption and desorption isotherm thus obtained by the BET method. In addition, the pore size distribution curve and the pore volume of the sample for measurement can be determined by analyzing the adsorption and desorption isotherm thus obtained by the BJH method.

The sum of the effective surface areas of all of the reverse current absorbing bodies (reverse current absorbing layers) equipped in one electrolysis cell is preferably from 10 to 100,000 $m^2$. Meanwhile, the effective surface area means the surface area including the pore of the reverse current absorbing layer. As described above, more electrochemical reactions proceed in the reverse current absorbing body (reverse current absorbing layer) having a larger specific surface area, and thus more electric quantity of the reverse current can be absorbed. For that reason, the reverse current absorbing body (reverse current absorbing layer) can sufficiently absorb the reverse current when the sum of the effective surface areas of all of the reverse current absorbing bodies (reverse current absorbing layers) equipped in one electrolysis cell is in the range described above.

<Effective Surface Area>

The sum (total effective surface area) of the effective surface areas of all of the reverse current absorbing bodies (reverse current absorbing layers) equipped in one electrolysis cell is calculated by multiplying the specific surface area ($m^2$/g) of the reverse current absorbing body (reverse current absorbing layer) measured by the nitrogen adsorption method by the amount (g) of all of the reverse current absorbing bodies (reverse current absorbing layers) equipped in one electrolysis cell.

<Oxidation-Reduction Ability and Charge and Discharge Ability>

The upper limits of the oxidation-reduction ability and charge and discharge ability of reverse current absorbing body (reverse current absorbing layer 18*b*) are not particularly limited. The oxidation-reduction ability and charge and discharge ability of reverse current absorbing layer are represented by the value obtained by dividing the sum of the electric quantities absorbable by all of the reverse current absorbing bodies (reverse current absorbing layers) installed in one electrolysis tank by the electrolytic area of the electrolysis tank. The electrolytic area of the electrolysis tank is equal to the sum of the areas of all of the cathodes or all of the anodes in the electrolysis tank. The reverse current absorbing body (reverse current absorbing layer) preferably has the oxidation-reduction ability exhibiting 1,000 C or more and 2,000,000 C or less of electric quantity per 1 $m^2$ of electrolytic area. In other words, the sum of the electric quantities absorbed by all of the reverse current absorbing bodies (reverse current absorbing layers) equipped in one electrolysis cell is preferably from 1,000 to 2,000,000 [Coulomb/$m^2$]. As described above, the amount of reverse current absorbing body counterbalancing to the electric quantity of the reverse current may be introduced in order to allow the reaction consuming the electric quantity enough to absorb the electric quantity of the reverse current to proceed in the reverse current absorbing layer. The reverse current absorbing body can sufficiently absorb the reverse current when the electric quantity absorbable by all of the reverse current absorbing bodies equipped in one electrolysis cell is in the range described above. By virtue of this, the degradation of the cathode can be more suppressed. Alternatively, the reverse current absorbing layer has the charge and discharge ability exhibiting preferably 2,000,000 C or less of electric quantity per 1 $m^2$ of electrolytic area and more preferably 1,500,000 C or less of electric quantity per 1 $m^2$ of electrolytic area.

The fact that the reverse current absorbing layer has the oxidation-reduction ability exhibiting 1,000 C or more of electric quantity per 1 $m^2$ of the electrolytic area means that an oxidation reaction or a reduction reaction can be caused on the surface of the reverse current absorbing layer when 1,000 C or more of electric quantity per 1 $m^2$ of electrolytic area flows therein.

The fact that the reverse current absorbing layer has the charge and discharge ability exhibiting 1,000 C or more of electric quantity per 1 $m^2$ of the electrolytic area means that charge can be performed on the surface of the reverse current absorbing layer when 1,000 C or more of electric quantity per 1 $m^2$ of electrolytic area flows therein.

The reverse current absorbing layer 18*b* may be a thin film shape, a powder shape, a plate-like shape, or a reticular shape. The reverse current absorbing layer 18*b* may be attached to the substrate 18*a* or coated on the substrate.

The specific surface area of the reverse current absorbing layer 18*b* is preferably from 0.01 to 100 $m^2/g$, more preferably from 0.01 to 30 $m^2/g$, and significantly preferably from 0.1 to 15 $m^2/g$ since a large quantity of reverse current can be absorbed. The specific surface area can be measured by the nitrogen adsorption method (BET method). The effect of the invention can be easily obtained when the specific surface area is 0.01 $m^2/g$ or more. Heat generation or firing does not occur when the reverse current absorbing body is exposed to the air after the electrolysis tank is stopped when the specific surface area is 100 $m^2/g$ or less and thus it is possible to handle safely.

The amount of reverse current absorbing layer counterbalancing to the electric quantity of the reverse current may be introduced in order to allow the oxidation reaction of the reverse current absorbing layer consuming the electric quantity enough to absorb the electric quantity of the reverse current to proceed. It is desirable that the reverse current absorbing layer has more surface areas in order to allow more electrochemical reactions to proceed in the reverse current absorbing layer since the electrochemical reaction is a surface reaction. For this reason, the reverse current absorbing body having a larger specific surface area allows more electrochemical reactions to proceed and thus can absorb more electric quantity of reverse current when two reverse current absorbing layers having the same mass are compared to each other. In addition, a reverse current absorbing layer having a greater mass has a greater total surface area and thus can absorb more electric quantity when two reverse current absorbing layers having the same specific surface area are compared to each other.

In order to form the reverse current absorbing layer 18*b* into a desired porous layer, a raw material powder such as metallic nickel powder or nickel oxide powder is granulated into a particle of from 10 to 100 μm, and then the reverse current absorbing layer 18*b* may be formed from the raw material powder by the thermal spraying method. It is because the adhesion of the reverse current absorbing layer 18*b* to the substrate 18*a* or the adhesion of the nickel particles in the reverse current absorbing layer 18*b* can be moderately improved by forming the reverse current absorbing layer by the thermal spraying method. In addition, the adhesion of the reverse current absorbing layer 18*b* to the current collector 23 is also moderately improved in a case in which the reverse current absorbing layer 18*b* is formed on the current collector 23. By virtue of this, the durability can also be improved.

The reverse current absorbing layer 18*b* may be formed by the thermal spraying method in order to obtain 0.6° or less of the full width at half maximum of a diffraction line peak of Ni metal at a diffraction angle 2θ=44.5° in a powder X-ray diffraction pattern of the reverse current absorbing layer 18*b*. In the thermal spraying method, the raw material powder such as metallic nickel powder or nickel oxide powder in a semi-molten state may be sprayed onto the substrate in the high temperature plasma. The raw material powder is preferably a powder granulated into a particle of from 10 to 100 By virtue of this, the adhesion between the substrate and the reverse current absorbing layer is improved. In addition, the raw material powder in a semi-molten state sprayed onto the substrate is cooled at the same time as being attached thereto and solidified, thereby forming a particle having moderately high crystallinity. The full width at half maximum of a diffraction line peak of Ni metal at a diffraction angle 2θ=44.5° in a powder X-ray diffraction pattern of the reverse current absorbing layer can be 0.6° or less by increasing the crystallinity of nickel metal in the reverse current absorbing layer in this manner.

In order to produce a reverse current absorbing layer, having a pore volume of the pores having a pore size of 10 nm or greater, of 80% or more of the total pore volume, a raw material powder such as metallic nickel powder or nickel oxide powder is granulated into a particle of from 10 to 100 μm, and then the reverse current absorbing layer may be formed from the raw material powder by the thermal spraying method.

(Reverse Current Absorbing Body)

The substrate 18*a* of the reverse current absorbing body 18 may be an independent substrate different from the current collector, the metal elastic body, the partition wall, and the support. The independent reverse current absorbing body can be easily attached to the existing cathode chamber of the electrolysis tank later. In other words, reverse current absorption capacity can be imparted to the existing cathode chamber of the electrolysis tank according to the independent reverse current absorbing body. The number of the reverse current absorbing body (substrate thereof) may be one or more than one. In addition, the shape of the substrate of the reverse current absorbing body may be a cube, a cuboid, a plate-like shape, a rod-like shape, a reticular shape, or a spherical shape. At least a part of the substrate of the reverse current absorbing body may be the metal elastic body, the partition wall, or the support. The reverse current absorbing body may be disposed between the cathode and the metal elastic body. The reverse current absorbing body may be disposed between the metal elastic body and the current collector. The reverse current absorbing body may be disposed between the current collector and the partition wall.

The reverse current absorbing body may be disposed between the cathode and the metal elastic body, in the metal elastic body, between the metal elastic body and the current collector, between the current collector and the partition wall, or on the partition wall in a case in which the substrate of the reverse current absorbing body is independent of the current collector, the metal elastic body, the partition wall, and the support. The reverse current absorbing body is directly electrically connected to the cathode in a case in which the reverse current absorbing body is between the cathode and the metal elastic body. The reverse current absorbing body is electrically connected to the cathode via the metal elastic body in a case in which the reverse current absorbing body is between the metal elastic body and the current collector. The reverse current absorbing body is electrically connected to the cathode via the current collector and the metal elastic body in a case in which the reverse current absorbing body is between the current collector and the partition wall. Alternatively, the reverse current absorbing body is electrically connected to the cathode via the support, the current collector, and the metal elastic body.

At least a part of the substrate of the reverse current absorbing body may be the metal elastic body and the reverse current absorbing layer may be formed on the surface of the metal elastic body. The reverse current absorbing body can absorb the reverse current when the reverse current absorbing layer is formed on the surface of the metal elastic body and the metal elastic body is electrically connected to the cathode. The reverse current absorbing body can be easily installed by simply placing the metal elastic body onto the current collector in a case in which the metal elastic body is the reverse current absorbing body. In addition, the protective effect of the cathode increases when the metal elastic body which is the reverse current absorbing body is in direct contact with the cathode. In addition, the replacement of the reverse current absorbing body can also be easily performed in a case in which the metal elastic body is the reverse current absorbing body.

At least a part of the substrate of the reverse current absorbing body is the partition wall and the reverse current absorbing layer may be formed on the surface of the partition wall. The reverse current absorbing layer formed on the partition wall can absorb the reverse current when the partition wall is electrically connected to the cathode through the support, the current collector, and the metal elastic body. It is also possible to reduce the manufacturing cost of the electrolysis cell when the partition wall is the reverse current absorbing body.

At least a part of the substrate of the reverse current absorbing body is the support and the reverse current absorbing layer may be formed on the surface of the support. The reverse current absorbing layer formed on the support can absorb the reverse current when the support body is electrically connected to the cathode through the current collector and the metal elastic body. It is also possible to reduce the manufacturing cost of the electrolysis cell when the support is the reverse current absorbing body.

At least a part of the substrate of the reverse current absorbing body is the current collector and the reverse current absorbing layer may be formed on the surface of the current collector. The reverse current absorbing layer formed on the current collector can absorb the reverse current when the current collector is electrically connected to the cathode through the metal elastic body. It is also possible to reduce the manufacturing cost of the electrolysis cell when the current collector is the reverse current absorbing body.

The sum of electric quantities absorbed by all of the reverse current absorbing bodies equipped in one electrolysis cell can be measured by, for example, the following method. The electric potential of the reverse current absorbing body in the aqueous solution of sodium hydroxide is set to the same electric potential (−1.2 V vs. Ag|AgCl) as during the salt electrolysis, thereafter the electric potential of the reverse current absorbing body is monitored while applying a reverse current by a constant current, and the time until the electric potential reaches a certain electric potential is measured. For example, the time until the electric potential of the reverse current absorbing body reaches −0.1 V (vs. Ag|AgCl) that is the electric potential at which the oxidative dissolution of Ru begins is measured. The electric quantity of the reverse current absorbable by all of the reverse current absorbing bodies until the oxidative dissolution of Ru is calculated by the product of this time and the current density of the reverse current.

Examples of the method of manufacturing the reverse current absorbing body may include a CVD method, a PVD method, a thermal decomposition method, and a thermal spraying method. The thermal spraying method is classified by the heat source or the material to be sprayed, and specific examples thereof may include flame spraying, high velocity flame spraying, arc spraying, plasma spraying, wire explosion spraying, and cold spraying. These methods may be combined. The reverse current absorbing body is obtained by forming the reverse current absorbing layer on the substrate by these methods. In addition, the reverse current absorbing body (or reverse current absorbing layer) may be subjected to a reduction treatment if necessary. Examples of the reduction treatment may include a method in which a reductant such as hydrogen or hydrazine is brought into direct contact with the reverse current absorbing body and a method in which the reverse current absorbing body is electrochemically reduced. Specific examples of the method of manufacturing the reverse current absorbing body may include a method in which nickel oxide powder, metallic nickel powder, or Raney nickel powder is thermal sprayed onto the substrate surface. The substrate thermal sprayed with this powder may be subjected to the hydrogen reduction or the electrolytic reduction. The electrolytic reduction may be performed as the electrolysis of an alkali metal compound at the time of using the reverse current absorbing body. The electrolysis of the aqueous solution of sodium hydroxide is preferably performed, for example, at a current density of from 0.1 to 15 $kA/m^2$ in a case in which the electrolytic reduction is performed at the time of using the reverse current absorbing body. At this time, the hydrogen evolution reaction mostly proceeds on the cathode but does not proceed on the reverse current absorbing body. However, the reverse current absorbing body is electrically connected to the cathode and thus the electric potential of the reverse current absorbing body is maintained at the hydrogen evolution potential, and as a result, the reverse current absorbing body is exposed to the reducing atmosphere.

The electrolytic reduction may be performed by such a method. In addition, the electrolytic reduction may be performed using the reverse current absorbing body as a cathode for hydrogen evolution in the electrolysis of an alkali metal compound. The electrolysis of the aqueous solution of sodium hydroxide is preferably performed, for example, at a current density of from 0.1 to 15 $kA/m^2$ in a case in which the electrolytic reduction is performed using the reverse current absorbing body as a cathode for hydrogen evolution.

(Partition Wall)

The partition wall 30 is disposed between anode chamber 10 and the cathode chamber 20. The partition wall 30 is referred to as the separator in some cases and separates anode chamber 10 from the cathode chamber 20. As the partition wall 30, a partition wall known as a separator for electrolysis can be used, and examples thereof may include a partition wall obtained by welding a nickel plate for the cathode side and a titanium plate for the anode side.

(Anode Chamber)

The anode chamber 10 has the anode 11. In addition, the anode chamber 10 preferably has an anode side electrolyte supply unit for supplying the electrolyte to the anode chamber 10, a baffle plate disposed upward the anode side electrolyte supply unit and substantially parallel to the partition wall 30, and an anode side gas liquid separation unit disposed upward the baffle plate and for separating gas from the electrolyte mixed with the gas.

(Anode)

The anode 11 is provided in the frame of the anode chamber 10. A metal electrode such as the so-called DSA (registered trademark: Permelec electrode) can be used as the anode 11. The DSA is a titanium substrate having a surface coated with an oxide having ruthenium, iridium, and titanium as a component.

(Anode Side Electrolyte Supply Unit)

The anode side electrolyte supply unit is for supplying the electrolyte to the anode chamber 10, and connected to the electrolyte supply tube. The anode side electrolyte supply unit is preferably disposed downward the anode chamber 10. As the anode side electrolyte supply unit, for example, a pipe having an opening formed on the surface (dispersion pipe) or the like can be used. The pipe is more preferably disposed along the surface of the anode 11 and parallel to a bottom part 19 of the electrolysis cell. This pipe is connected to the electrolyte supply tube (liquid supply nozzle) for supplying the electrolyte into the electrolysis cell 1. The electrolyte supplied through the liquid supply nozzle is conveyed into the electrolysis cell 1 by the pipe and supplied to the inside of the anode chamber 10 through an opening provided on the surface of the pipe. The pipe is preferably disposed along the surface of the anode 11 and parallel to the bottom part 19 of the electrolysis cell since the electrolyte can be uniformly supplied to the inside of the anode chamber 10.

(Anode Side Gas Liquid Separation Unit)

The anode side gas liquid separation unit is preferably disposed upward the baffle plate. The anode side gas liquid separation unit has a function to separate the produced gas such as chlorine gas from the electrolyte during the electrolysis. Meanwhile, unless otherwise specified, the upper means the upward direction in the electrolysis cell 1 of FIG. 1 and the lower means downward direction in the electrolysis cell 1 of FIG. 1.

At the time of electrolysis, vibration occurs by the pressure fluctuation inside the electrolysis cell 1 when the produced gas generated in the electrolysis cell 1 and the electrolyte are discharged out of the system in a mixed phase (gas-liquid mixed phase), and thus physical damage of the ion exchange membrane may be caused. In order to suppress this, an anode side gas liquid separation unit for separating a gas from a liquid is preferably provided in the electrolysis cell 1 of the present embodiment. A defoaming plate for clearing the bubbles is preferably installed in the anode side gas liquid separation unit. The bubbles may burst when the gas-liquid mixed phase flow passes through the defoaming plate, and thus the gas can be separated from the electrolyte. As a result, vibration at the time of electrolysis can be prevented.

(Baffle Plate)

The baffle plate is preferably disposed upward the anode side electrolyte supply unit and substantially parallel to the partition wall 30. The baffle plate is a partition plate for controlling the flow of electrolyte in the anode chamber 10. The electrolyte (salt water or the like) in the anode chamber 10 is internally circulated by providing the baffle plate and thus the concentration thereof can be uniform. In order to cause internal circulation, the baffle plate is preferably disposed so as to separate the space in the vicinity of the anode 11 from the space in the vicinity of partition wall 30. From this point of view, the baffle plate is preferably provided so as to face the respective surfaces of the anode 11 and the partition wall 30. The concentration of the electrolyte (salt water concentration) decreases as the electrolysis proceeds and the produced gas such as chlorine gas is generated in the space in the vicinity of the anode separated by the baffle plate. By virtue of this, difference in specific gravity of the gas and the liquid is caused in the space in the vicinity of the anode 11 and the space in the vicinity of the partition wall 30 which are separated by the baffle plate. By using this, the internal circulation of the electrolyte in the anode chamber 10 is promoted and thus the concentration distribution of the electrolyte in the anode chamber 10 can be more uniform.

Meanwhile, a current collector may be separately provided in the inside of the anode chamber 10 although not illustrated in FIG. 1. The current collector may be the same material or have the same constitution as the current collector of the cathode chamber to be described below. In addition, the anode 11 itself can function as a current collector in the anode chamber 10.

(Cathode Chamber)

The cathode chamber 20 has the cathode 21 and the reverse current absorbing body, and the cathode 21 and the reverse current absorbing body are electrically connected. In addition, the cathode chamber 20 also preferably has a cathode side electrolyte supply unit and a cathode side gas liquid separation unit in the same manner as the anode chamber 10. Meanwhile, the description on the same parts as the respective parts constituting the anode chamber 10 among the respective parts constituting the cathode chamber 20 will be omitted.

(Current Collector)

The cathode chamber 20 is preferably equipped with the current collector 23. By virtue of this, the current collecting effect is enhanced. In the first embodiment, the current collector 23 has a plate-like shape and is preferably disposed substantially parallel to the surface of the cathode 21.

The current collector 23 is preferably formed of, for example, a metal exhibiting electrical conductivity such as nickel, iron, copper, silver, and titanium. The current collector 23 may be a mixture, an alloy, or a composite oxide of these metals. Meanwhile, the shape of the current collector 23 may be any shape as long as the shape functions as a current collector and may be a reticular shape.

(Metal Elastic Body)

When the metal elastic body 22 is disposed between the current collector 23 and the cathode 21, the respective cathodes 21 of the plural electrolysis cells 1 connected in series are pressed against the ion exchange membrane 2, the distance between the respective anodes 11 and the respective cathodes 21 decreases, and thus it is possible to decrease the voltage applied to whole of the plural electrolytic cells 1 connected in series. The electric power consumption can be decreased as the voltage decreases.

As the metal elastic body 22, a spring member such as spiral spring or coil, a cushioning mat, or the like can be used. As the metal elastic body 22, an appropriately suitable metal elastic body can be adopted in consideration of the stress pressed against the ion exchange membrane or the like. The metal elastic body 22 may be provided on the surface of the current collector 23 of the cathode chamber 20 side or the surface of the partition wall of the anode chamber 10 side. The metal elastic body 22 is preferably provided between the current collector 23 and the cathode 21 of the cathode chamber 20 from the viewpoint of the strength or the like of the frame since the two chambers are usually partitioned such that the cathode chamber 20 is smaller than the anode chamber 10. In addition, the metal elastic body 23 is preferably formed of a metal exhibiting electrical conductivity such as nickel, iron, copper, silver, and titanium.

(Support)

The cathode chamber 20 is preferably equipped with the support 24 electrically connecting the current collector 23 and the partition wall 30. By virtue of this, the current can efficiently flow.

The support 24 is preferably formed of a metal exhibiting electrical conductivity such as nickel, iron, copper, silver, and titanium. In addition, the shape of the support 24 may be any shape as long as the shape can support the current collector 23 and may be a rod-like shape, a plate-like shape, or a reticular shape. In the first embodiment, the support 24 is a plate-like shape. The plural supports 24 are disposed between partition wall 30 and the current collector 23. The plural supports 24 are lined up such that the respective surfaces thereof are parallel to each other. The support 24 is substantially perpendicularly disposed with respect to the partition wall 30 and the current collector 23.

(Anode Side Gasket and Cathode Side Gasket)

The anode side gasket is preferably disposed on the surface of the frame constituting the anode chamber 10. The cathode side gasket is preferably disposed on the surface of the frame constituting the cathode chamber 20. The electrolysis cells are connected to each other such that the ion exchange membrane 2 sandwiched between the anode side gasket equipped in one electrolysis cell and the cathode side gasket of the electrolysis cell adjacent thereto (see FIGS. 2 and 3). Airtightness can be imparted to the connecting places when the plural electrolysis cells 1 are connected in series via the ion exchange membrane 2 by these gaskets.

The gasket is used to seal between the ion exchange membrane and the electrolysis cell. Specific examples of the gasket may include a frame-shaped rubber sheet having an opening formed in the center. It is desired for the gasket to have resistance to a corrosive electrolyte or generated gas and to be usable for a long period of time. Hence, a vulcanized product of ethylene propylene diene rubber (EPDM rubber) or ethylene propylene rubber (EPM rubber), a peroxide crosslinked product, or the like is usually used as a gasket in terms of chemical resistance and hardness. In addition, it is also possible to use a gasket in which the region in contact with the liquid (wetted part) is coated with a fluorine-based resin such as polytetrafluoroethylene (PTFE) or tetrafluoroethylene perfluoroalkyl vinyl ether copolymer (PFA) if necessary. The shape of these gaskets is not particularly limited as long as the gaskets respectively have an opening so as not to block the flow of the electrolyte. For example, a frame-shaped gasket is stuck along the periphery of each opening of the anode chamber frame constituting the anode chamber 10 or the cathode chamber frame constituting the cathode chamber 20 with an adhesive or the like. In addition, each of the electrolysis cells 1 stuck with a gasket may be fastened via the ion exchange membrane 2, for example, in a case in which two electrolysis cells 1 are connected via the ion exchange membrane 2 (see FIG. 2). By virtue of this, it is possible to prevent the electrolyte, the alkali metal hydroxide generated by the electrolysis, chlorine gas, hydrogen gas, or the like from leaking out of the electrolysis cell 1.

(Ion Exchange Membrane 2)

The ion exchange membrane 2 is not particularly limited, and a known ion exchange membrane can be used. A fluorine-containing ion exchange membrane is preferable from the viewpoint of excellent heat resistance, chemical resistance, or the like, for example, in a case in which chlorine and alkali are produced by the electrolysis of alkali chloride or the like. Examples of the fluorine-containing ion exchange membrane may include an ion exchange membrane containing a fluorine-containing polymer having a function selectively permeable the cations generated during the electrolysis and having an ion exchange group. Here, the fluorine-containing polymer having an ion exchange group refers to a fluorine-containing polymer having an ion exchange group or an ion exchange group precursor convertible to an ion exchange group by hydrolysis. Examples of such a fluorine-containing polymer may include a polymer which consists of a fluorinated hydrocarbon main chain, has a functional group convertible to an ion exchange group by hydrolysis or the like as a pendant side chain, and is subjectable to a melt process.

Second Embodiment

A second embodiment is the same as the first embodiment except the following differences. Hereinafter, only the differences between the first embodiment and the second embodiment will be described, and the description on the common subject matters of both embodiments will be omitted. According to the second embodiment, it is possible to suppress the oxidation and degradation of the cathode in the same manner as the first embodiment.

Figure 6:
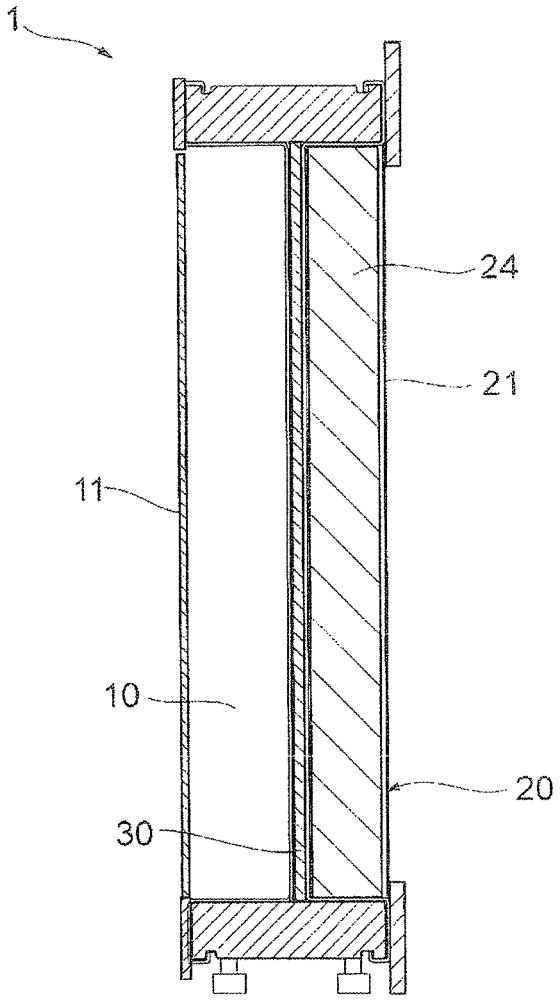
FIG. 6 is a schematic cross-sectional view of an electrolysis cell according to a second embodiment of the invention.

FIG. 6 is a cross-sectional view of the electrolysis cell 1 according to the second embodiment. The electrolysis cell 1 according to the second embodiment is different from the electrolysis cell 1 according to the first embodiment in that a metal elastic body and a current collector are not equipped therein. The cathode chamber 20 equipped in the electrolysis cell 1 of the second embodiment has a support 24 disposed between a cathode 21 and a partition wall 30. The support 24 supports the cathode 21. The partition wall 30 is electrically connected to the cathode 21 through the support 24.

In the second embodiment, a substrate 18*a* of a reverse current absorbing body 18 may be independent of the partition wall and the support. The reverse current absorbing body is disposed, for example, between the cathode and the partition wall. The reverse current absorbing body may be electrically connected directly to the cathode or the surface of the partition wall.

At least a part of the substrate of the reverse current absorbing body is the support and a reverse current absorbing layer may be formed on the surface of the support. The reverse current absorbing layer formed on the support can absorb the reverse current when the support is electrically connected to the cathode through a current collector and a metal elastic body. It is possible to suppress the manufacturing cost of the electrolysis cell when the support is the reverse current absorbing body.

At least a part of the substrate of the reverse current absorbing body is the partition wall and the reverse current absorbing layer may be formed on the surface of the partition wall. The reverse current absorbing layer formed on the partition wall can absorb the reverse current when the partition wall is electrically connected to the cathode through the support, the current collector, and the metal elastic body. It is possible to suppress the manufacturing cost of the electrolysis cell when the partition wall is the reverse current absorbing body.

EXAMPLES

The invention will be described in more detail with reference to the following Examples and Comparative Examples, but the invention is not intended to be limited by the following Examples.

Example 1

The surface of nickel expanded metal (substrate) was plasma sprayed with nickel oxide powder, thereby coating the substrate with nickel oxide powder (reverse current absorbing layer). Nitrogen was used as the primary gas for the plasma spraying and hydrogen was used as the secondary gas. The electrolysis of salt to generate hydrogen was performed using the substrate coated with the reverse current absorbing layer as the cathode. The reverse current absorbing body of Example 1 was obtained through the reduction treatment by the electrolysis. Meanwhile, the conditions at the time of the electrolysis were as follows. Current density: 4 kA/m$^2$, electrolysis temperature: 90° C., and concentration of sodium hydroxide: 32% by weight.

(Evaluation on Reverse Current Absorption)

The reverse current absorbing body was cut into a size of 3 cm×3 cm and fixed to a nickel rod coated with PTFE with nickel screws. A platinum plate was used as the counter electrode (anode).

The reverse current absorbing body was installed in a 32% by weight aqueous solution of sodium hydroxide, and the electric current was applied for 1 hour between the platinum plate and the reverse current absorbing body to generate hydrogen by the electrolysis of the aqueous solution of sodium hydroxide. The current density at the time of the electrolysis was 4 kA/m$^2$. Thereafter, the electric potential of the reverse current absorbing body was measured while applying the reverse current having a current density of 250 A/m$^2$ between the platinum plate and the reverse current absorbing body. The electric potential of the reverse current absorbing body is the electric potential of the reverse current absorbing body with respect to the Ag|AgCl reference electrode, and the Luggin tube was used for the measurement of the electric potential. The time T from when the reverse current started to flow to when the electric potential of the reverse current absorbing body reached the electric potential of the oxidative dissolution reaction of Ru (−0.1 V) was measured. The time T was 3846 seconds. The electric quantity flowed between the platinum plate and the reverse current absorbing body (quantity of the reverse current absorbed by the reverse current absorbing body, unit: C/m$^2$) was calculated by the product of the time T and the current density of 250 A/m$^2$. The quantity of the reverse current absorbed by the reverse current absorbing body was 961,500 C/m$^2$. The specific surface area of the reverse current absorbing body measured by the nitrogen adsorption method was 3.3 m$^2$/g. In addition, the reverse current absorbing body of Example 1 did not cause heat generation and firing immediately after the preparation. In addition, the reverse current absorbing body of Example 1 did not cause heat generation and firing even when taken out into the air without applying the reverse current after the electrolysis of the aqueous solution of sodium hydroxide.

(Electrolysis Experiment)

The influence of the reverse current on the cathode was evaluated by the following electrolysis experiment. The electrolysis cell was fabricated with a transparent acrylic material in order to observe the inside of the cathode chamber of the electrolysis cell from the outside. The anode cell having an anode chamber installed with an anode (anode terminal cell) and the cathode cell having a cathode chamber installed with the cathode (cathode terminal cell) were combined to face each other. A pair of gaskets was disposed between the cells, and an ion exchange membrane was sandwiched between the pair of gaskets. Then, the anode cell, the gasket, the ion exchange membrane, the gasket, and the cathode were tightly attached to obtain an electrolysis cell.

As the anode, the so-called DSA (registered trademark) in which an oxide having ruthenium, iridium and titanium as a component was formed on a titanium substrate was used. As the cathode, a nickel plain weave wire mesh coated with ruthenium oxide and cerium oxide was used. The four sides of the cathode cut into a size of 95 mm in length×110 mm in width were bent at a right angle by about 2 mm. As the current collector, a nickel expanded metal was used. The size of the current collector was 95 mm in length×110 mm in width. As the metal elastic body, a mat woven with a nickel thin wire was used. The mat of the metal elastic body was placed on the current collector. The cathode was covered on the current collector in a state where the bent portion of the cathode was toward the current collector. Then, the four corners of the cathode were fixed to the current collector with a string fabricated with Teflon (registered trademark). As the gasket, an EPDM (ethylene propylene diene) rubber gasket was used. As the ion exchange membrane, the "Aciplex" (registered trademark) F6801 (manufactured by Asahi Kasei Chemicals Corporation) was used.

The reverse current absorbing body was attached in the center of the current collector installed in the cathode chamber of the electrolysis cell by welding. The substrate part of the reverse current absorbing body was welded to the current collector and the reverse current absorbing layer part thereof was exposed into the cathode chamber. In other words, in the electrolysis cell of Example 1, the reverse current absorbing body was installed on the current collector and electrically connected to the cathode via the mat of the metal elastic body.

The electrolysis of salt was performed using the electrolysis cell described above. The concentration of salt water (concentration of sodium chloride) in the anode chamber was adjusted to 205 g/L. The concentration of sodium hydroxide in the cathode chamber was adjusted to 32% by weight. The temperature of each of the anode chamber and the cathode chamber was adjusted such that the temperature inside each of the electrolysis cells was 90° C.

The electrolysis of salt was performed for 2 hours at a current density of 6 kA/m$^2$ and then the current density was dropped to 0 kA/m$^2$ at once. Thereafter, the plus and the minus of the rectifier terminals were switched and the electric current (reverse current) in the direction opposite to the electrolysis was applied to the electrolysis cell. The current density of the reverse current was set to 50 A/m$^2$. The electric potential of the cathode with respect to the Ag|AgCl reference electrode was measured using the Luggin tube introduced into the cathode chamber while the reverse current was flowing.

It took 1936 seconds from when the reverse current started to flow to when the electric potential of the cathode reached the electric potential of the oxidative dissolution reaction of Ru (−0.1 V (vs. Ag|AgCl)). At this time, the dissolution of Ru from the catalytic layer was not observed in the cathode chamber. The electric quantity of the reverse current flowed during the 1936 seconds was 96,800 C/m$^2$ per one electrolysis cell.

The reverse current was continuously applied, and the dissolution of Ru was observed when the electric potential of the cathode exceeded −0.1 V (vs. Ag|AgCl) and the electrolyte of the cathode chamber was colored to brown. Moreover, the reverse current was continuously applied, and the electric potential of the cathode reached the electric potential of oxygen evolution reaction (+0.3 V vs. Ag|AgCl) and oxygen evolution was observed.

Example 2

The surface of nickel expanded metal (substrate) was plasma sprayed with nickel oxide powder, thereby coating the substrate with nickel oxide powder (reverse current absorbing layer). Nitrogen was used as the primary gas for the plasma spraying and hydrogen was used as the secondary gas. The reverse current absorbing body of Example 2 was obtained by the reduction treatment of the substrate coated with the reverse current absorbing layer in a hydrogen atmosphere. The conditions for the hydrogen reduction were as follows.

Hydrogen concentration in the atmosphere: 100%, temperature of the atmosphere: 200° C., and reduction time: 1 hour.

(Evaluation on Reverse Current Absorption)

The quantity of the reverse current absorbed by the reverse current absorbing body of Example 2 was evaluated in the same manner as in Example 1. The time T until the electric potential of the reverse current absorbing body of Example 2 reached −0.1 V (vs. Ag|AgCl) was 1655 seconds. The quantity of the reverse current absorbed by the reverse current absorbing body of Example 2 was 413,750 C/m$^2$. In addition, the specific surface area of the reverse current absorbing body of Example 2 measured by the nitrogen adsorption method was 4.2 m$^2$/g. In addition, the reverse current absorbing body of Example 2 did not cause heat generation and firing immediately after the preparation. In addition, the reverse current absorbing body of Example 2 did not cause heat generation and firing even when taken out into the air without applying the reverse current after the electrolysis of the aqueous solution of sodium hydroxide.

(Electrolysis Experiment)

The electrolysis experiment of Example 2 was performed using the same electrolysis cell as in Example 1 except being equipped with the reverse current absorbing body of Example 2 instead of the reverse current absorbing body of Example 1.

It took 1137 seconds from when the reverse current started to flow to when the electric potential of the cathode reached the electric potential of the oxidative dissolution reaction of Ru (−0.1 V (vs. Ag|AgCl)). At this time, the dissolution of Ru from the catalytic layer was not observed in the cathode chamber. The electric quantity of the reverse current flowed during the 1137 seconds was 56,850 C/m$^2$ per one electrolysis cell.

The reverse current was continuously applied, and the dissolution of Ru was observed when the electric potential of the cathode exceeded −0.1 V (vs. Ag|AgCl) and the electrolyte of the cathode chamber was colored to brown. Moreover, the reverse current was continuously applied, and the electric potential of the cathode reached the electric potential of oxygen evolution reaction (+0.3 V vs. Ag|AgCl) and oxygen evolution was observed.

Example 3

The reverse current absorbing body of Example 3 was obtained by plasma spraying the surface of nickel expanded metal (substrate) with nickel oxide powder to coat the substrate with nickel oxide powder (reverse current absorbing layer). Nitrogen was used as the primary gas for the plasma spraying and hydrogen was used as the secondary gas.

(Evaluation on Reverse Current Absorption)

The quantity of the reverse current absorbed by the reverse current absorbing body of Example 3 was evaluated in the same manner as in Example 1. The time T until the electric potential of the reverse current absorbing body of Example 3 reached −0.1 V (vs. Ag|AgCl) was 201 seconds. The quantity of the reverse current absorbed by the reverse current absorbing body of Example 3 was 50,250 C/m$^2$. In addition, the specific surface area of the reverse current absorbing body of Example 3 measured by the nitrogen adsorption method was 0.5 m$^2$/g. In addition, the reverse current absorbing body of Example 3 did not cause heat generation and firing immediately after the preparation. In addition, the reverse current absorbing body of Example 3 did not cause heat generation and firing even when taken out into the air without applying the reverse current after the electrolysis of the aqueous solution of sodium hydroxide.

(Electrolysis Experiment)

The electrolysis experiment of Example 3 was performed using the same electrolysis cell as in Example 1 except being equipped with the reverse current absorbing body of Example 3 instead of the reverse current absorbing body of Example 1.

It took 620 seconds from when the reverse current started to flow to when the electric potential of the cathode reached the electric potential of the oxidative dissolution reaction of Ru (−0.1 V (vs. Ag|AgCl)). At this time, the dissolution of Ru from the catalytic layer was not observed in the cathode chamber. The electric quantity of the reverse current flowed during the 620 seconds was 31,000 C/m$^2$ per one electrolysis cell.

Example 4

The reverse current absorbing body prepared in Example 2 and the cathode sample prepared by coating a nickel plain weave wire mesh with ruthenium oxide and cerium oxide were cut into a size of 3 cm×3 cm, respectively. The four corners of the reverse current absorbing body and the four corners of the cathode were superimposed to fit to each other, and then the four corners were fixed by tying with a string manufactured with Teflon (registered trademark), thereby electrically connecting the reverse current absorbing body to the cathode. This cathode of Example 4 was fixed to a nickel rod coated with PTFE with nickel screws. A platinum plate was used as the counter electrode (anode).

Fe was added to an aqueous solution of sodium hydroxide having a concentration of 32% by weight, thereby adjusting the content of Fe in the aqueous solution to 10 ppm. The cathode and anode described above were installed in this aqueous solution and the hydrogen evolution electrolysis was performed. The current density at the time of electrolysis was 4 kA/m$^2$, and the temperature of the aqueous solution was adjusted to 90° C.

The electric potential of the cathode was continuously measured while continuing the electrolysis. The electric potential of this cathode is the electric potential of the cathode with respect to the Ag|AgCl reference electrode, and the Luggin tube was used for the measurement of the electric potential. In addition, the solution resistance was measured by the current interrupter method. Then, the hydrogen overvoltage of the cathode was calculated by the following equation (I).

$$\text{Hydrogen overvoltage of cathode [mV]} = -(\text{cathode potential) [mV]} - (\text{solution resistance) [mV]} - 1089\ [\text{mV}] \quad (I)$$

The aqueous solution of sodium hydroxide was replaced in four hours after the start of electrolysis. The concentration of Fe in the aqueous solution of sodium hydroxide was also adjusted to 10 ppm after the replacement.

Figure 7:
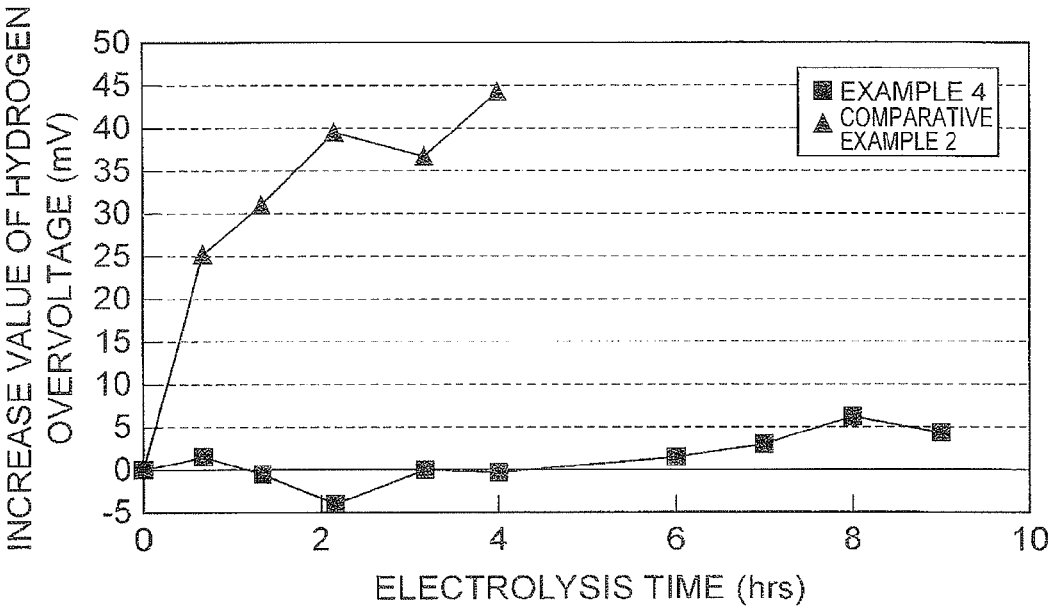
FIG. 7 is a graph illustrating the time course of hydrogen overvoltage of a cathode during electrolysis in Example 4 and Comparative Example 2 of the invention.

The increase value of the hydrogen overvoltage of the cathode at each time point from the start of the electrolysis of Example 4 until 9 hours has passed is illustrated in FIG. 7. As illustrated in FIG. 7, an increase in hydrogen overvoltage of the cathode of Example 4 was hardly observed during the time from the start of the electrolysis until 9 hours has passed. In other words, the resistance of the cathode of Example 4 with respective to Fe was confirmed.

(Electrolysis Experiment)

The electrolysis experiment of Example 5 was performed in the same manner as in Example 1 except that the cathode chamber (cathode terminal cell) of the electrolysis cell used was manufactured with Ni and the reverse current absorbing body of Example 3 was attached to the partition wall. The reverse current absorbing body was electrically connected to the cathode via the support, the current collector, and a mat woven with a nickel thin wire. In addition, the size of the reverse current absorbing body attached to the partition wall was a size of 5 cm×10 cm.

It took 2576 seconds from when the reverse current started to flow to when the electric potential of the cathode reached the electric potential of the oxidative dissolution reaction of Ru (−0.1 V (vs. Ag|AgCl)). At this time, the dissolution of Ru from the catalytic layer was not observed in the cathode chamber. The electric quantity of the reverse current flowed during the 2576 seconds was 128,800 $C/m^2$ per one electrolysis cell.

Comparative Example 1

Electrolysis Experiment

The electrolysis experiment of Comparative Example 1 was performed using the same electrolysis cell as in Example 1 except not being equipped with a reverse current absorbing body.

It took 475 seconds from when the reverse current started to apply to when the electric potential of the cathode reached the electric potential of the oxidative dissolution reaction of Ru (−0.1 V (vs. Ag|AgCl)). The electric quantity of the reverse current flowed during the 475 seconds was 23,750 $C/m^2$ per one electrolysis cell.

The reverse current was continuously applied, and the dissolution of Ru was observed when the electric potential of the cathode exceeded −0.1 V (vs. Ag|AgCl) and the electrolyte of the cathode chamber was colored to brown. Moreover, the reverse current was continuously applied, and the electric potential of the cathode reached the electric potential of oxygen evolution reaction (+0.3 V vs. Ag|AgCl) and oxygen evolution was observed.

Comparative Example 2

The same experiment as in Example 4 except that the reverse current absorbing body of Example 4 was not equipped was performed. The hydrogen overvoltage of the cathode of Comparative Example 2 increased by 25 mV in 30 minutes from the start of the electrolysis and increased by 44 mV after the electrolysis for 4 hours.

Comparison of Examples 1 to 3 and 5 with Comparative Example 1

It took 1936 seconds until the electric potential of the cathode reached the electric potential of the oxidative dissolution reaction of Ru in the electrolysis of Example 1 using a reverse current absorbing body since the reverse current absorbing body consumes the reverse current. It took 1137 seconds until the electric potential of the cathode reached the electric potential of the oxidative dissolution reaction of Ru in the electrolysis of Example 2 equipped with a reverse current absorbing body as well since the reverse current absorbing body consumes the reverse current. It took 620 seconds until the electric potential of the cathode reached the electric potential of the oxidative dissolution reaction of Ru in the electrolysis of Example 3 equipped with a reverse current absorbing body as well since the reverse current absorbing body consumes the reverse current. It took 2576 seconds until the electric potential of the cathode reached the electric potential of the oxidative dissolution reaction of Ru in the electrolysis of Example 5 equipped with a reverse current absorbing body as well since the reverse current absorbing body consumes the reverse current. On the other hand, it was found out that the electric potential of the cathode reached the electric potential of the oxidative dissolution reaction of Ru in a shorter time (475 seconds) in the electrolysis of Comparative Example 1 not using a reverse current absorbing body compared to Examples 1 to 3 and 5 since there was no reverse current absorbing body to consume the reverse current.

It has been found out that the dissolution of Ru in the electrolysis cell of Comparative Example 1 begins at an earlier time than Examples 1 to 3 and 5 from the fact that the electric potential of the cathode of Comparative Example 1 reached the electric potential of the oxidative dissolution reaction of Ru at an earlier time than Examples 1 to 3 and 5 and the dissolution of Ru was observed when the electric potential exceeded the electric potential of the oxidative dissolution reaction of Ru. Consequently, it has been found out that more amount of Ru dissolves out in the electrolysis cell of Comparative Example 1 than in those of Examples 1 to 3 and 5 when the reverse current flows for the same time as in Example 1.

An oxide is formed in the cathode by the reverse current even in a case in which the component of the catalytic layer is an element (Pt, Pd, Rh, Ir, . . . , or the like) other than Ru, and the physical peeling of the catalytic layer occurs as a result. However, according to the invention, it is possible to suppress a rapid increase in the electric potential of the cathode by the use of the reverse current absorbing body as demonstrated in Examples 1 to 3 and 5. Hence, according to the invention, the oxidation and degradation of the cathode can be suppressed even in an electrolysis cell equipped with a cathode using a catalytic component other than Ru.

Comparison of Example 4 with Comparative Example 2

The hydrogen overvoltage of the cathode hardly increased in the electrolysis of Example 4 using a reverse current absorbing body even after 9 hours. On the other hand, the hydrogen overvoltage of the cathode increased with the passage of electrolysis time in the electrolysis of Comparative Example 2. From this result, it has been confirmed that the resistance of the cathode with respect to Fe is improved as a reverse current absorbing body is attached.

(Evaluation on Reverse Current Absorption)

A sample of current collector having a reverse current absorbing layer formed thereon was cut into a size of 3 cm×3 cm and fixed to a nickel rod coated with PTFE with nickel screws. A platinum plate was used as the counter electrode (anode). The sample and the platinum plate were installed in a 32% by weight aqueous solution of sodium hydroxide, and the electric current was applied for 1 hour between the sample and the platinum plate to generate hydrogen by the electrolysis of the aqueous solution of sodium hydroxide. During this electrolysis, the electric potential of the reverse current absorbing layer of the sample with respect to the Ag|AgCl reference electrode was measured through the Luggin tube, and the electric potential of the reverse current absorbing layer was maintained at −1.2 V (vs. Ag|AgCl). Thereafter, the electric potential of the reverse current absorbing layer was measured while applying the reverse current having a current density of 250 A/m$^2$ between the sample and the platinum plate. The time T from when the reverse current started to flow to when the electric potential of the reverse current absorbing layer reached the electric potential of the oxidative dissolution reaction of Ru (−0.1 V) was measured. The electric quantity flowed between the sample and the platinum plate (quantity of the reverse current absorbed by the reverse current absorbing layer, unit: C/m$^2$) was calculated by the product of the time T and the current density of 250 A/m$^2$.

(Evaluation on Durability)

The durability of the reverse current absorbing layer was measured by the following method. A sample of current collector having a reverse current absorbing layer formed thereon was cut into a size of 3 cm×3 cm and fixed to a nickel rod coated with PTFE with nickel screws. A platinum plate was used as the counter electrode. The sample and the platinum plate were installed in a 48% by weight aqueous solution of sodium hydroxide, and the electrolysis was performed for 5 hours at a current density of 12 kA/m$^2$ and an electrolysis temperature of 120° C., thereafter, the reverse electrolysis was performed for 1 hour at 50 A/m$^2$. This cycle consisting of electrolysis and reverse electrolysis was repeated. The current collector having the reverse current absorbing layer formed thereon was taken out after a predetermined time has elapsed, and the evaluation on the reverse current absorption and the presence or absence of the peeling of the reverse current absorbing layer by visual inspection was performed. The durability of the reverse current absorbing layer was evaluated to be high in a case in which the quantity of reverse current absorbed by the reverse current absorbing layer was maintained and the peeling of the reverse current absorbing layer was not acknowledged after the electrolysis for a predetermined time.

Example 11

Nickel expanded metal was used as the current collector, and the surface of the current collector was plasma sprayed with nickel oxide powder to coat the surface of the current collector with nickel oxide powder, thereby forming a reverse current absorbing layer which is a porous layer. Nitrogen was used as the primary gas for the plasma spraying and hydrogen was used as the secondary gas.

The evaluation on the reverse current absorption was performed. As a result, a behavior was exhibited in which an oxidation reaction from metallic nickel of the reverse current absorbing layer to nickel hydroxide proceeded when the electric potential of the reverse current absorbing layer was about −0.9 V (vs. Ag|AgCl), and the electric potential increased again after this electric potential was maintained. The electric quantity flowed into the reverse current absorbing layer (reverse current absorption) until the electric potential of the reverse current absorbing layer reached −0.1 V (vs. Ag|AgCl) was 58,000 C/m$^2$. Next, the evaluation on the durability of this reverse current absorbing layer was performed. The evaluation on the reverse current absorption was performed after the cycle (electrolysis and reverse electrolysis) was repeated 250 times over 1500 hours, as a result, the electric quantity flowed into the reverse current absorbing layer until the electric potential of the reverse current absorbing layer reached −0.1 V (vs. Ag|AgCl) was 519,500 C/m$^2$. In addition, the peeling of the reverse current absorbing layer was not acknowledged after the electrolysis for 1500 hours.

In the present Example, the reverse current absorption of the reverse current absorbing layer increased after the electrolysis for 1500 hours. The reason for this is that the specific surface area of the reverse current absorbing layer containing Ni and NiO increased by the electrolysis and thus the reaction surface area increased and the proportion of Ni increased by the reduction of NiO. The evaluation results of the reverse current absorption, the durability, and the reverse current absorption after the electrolysis for 1500 hours (written as "reverse current absorption (after electrolysis)" in Table 1) are presented in Table 1.

Example 12

Nickel expanded metal was used as the current collector, and the surface of the current collector was plasma sprayed with nickel oxide powder to coat the surface of the current collector with nickel oxide powder, thereby forming a reverse current absorbing layer which is a porous layer. Nitrogen was used as the primary gas for the plasma spraying and hydrogen was used as the secondary gas.

The evaluation on the reverse current absorption was performed. As a result, the electric quantity flowed into the reverse current absorbing layer until the electric potential of the reverse current absorbing layer reached −0.1 V (vs. Ag|AgCl) was 21,550 C/m$^2$.

Next, the evaluation on the durability of this reverse current absorbing layer was performed. The evaluation on the reverse current absorption was performed after the cycle (electrolysis and reverse electrolysis) was repeated 250 times over 1500 hours, as a result, the electric quantity flowed into the reverse current absorbing layer until the electric potential of the reverse current absorbing layer reached −0.1 V (vs. Ag|AgCl) was 44,250 C/m$^2$. In addition, the peeling of the reverse current absorbing layer was not acknowledged after the electrolysis for 1500 hours.

In the present Example, the reverse current absorption of the reverse current absorbing layer increased after the electrolysis for 1500 hours. The reason for this is that the specific surface area of the reverse current absorbing layer which is a porous layer of Ni increased by the electrolysis and thus the reaction surface area increased. The evaluation results of the reverse current absorption, the durability, and the reverse current absorption after the electrolysis for 1500 hours (written as "reverse current absorption (after electrolysis)" in Table 1) are presented in Table 1.

Example 13

Nickel expanded metal was used as the current collector, and the surface of the current collector was plasma sprayed with nickel oxide powder to coat the surface of the current collector with nickel oxide powder. Nitrogen was used as the primary gas for the plasma spraying and hydrogen was used as the secondary gas. Moreover, the reduction of nickel oxide was performed by the electrolysis of salt to generate hydrogen, thereby forming a reverse current absorbing layer which is a porous layer. Meanwhile, the conditions of the electrolysis of salt at the time of reducing nickel oxide were as follows. Current density: 4 kA/m$^2$, concentration of sodium hydroxide: 32% by weight, and temperature: 90° C.

The evaluation on the reverse current absorption was performed. As a result, the electric quantity flowed into the reverse current absorbing layer until the electric potential of the reverse current absorbing layer reached −0.1 V (vs. Ag|AgCl) was 885,500 C/m$^2$.

Next, the evaluation on the durability of this reverse current absorbing layer was performed. The evaluation on the reverse current absorption was performed after the cycle (electrolysis and reverse electrolysis) was repeated 250 times over 1500 hours, as a result, the electric quantity flowed into the reverse current absorbing layer until the electric potential of the reverse current absorbing layer reached −0.1 V (vs. Ag|AgCl) was 910,250 C/m$^2$. In addition, the peeling of the reverse current absorbing layer was not acknowledged after the electrolysis for 1500 hours.

It has been found out that the reverse current absorbing layer of the present Example exhibits high durability as the reverse current absorption thereof has been maintained even after the electrolysis for 1500 hours. The evaluation results of the reverse current absorption, the durability, and the reverse current absorption after the electrolysis for 1500 hours (written as "reverse current absorption (after electrolysis)" in Table 1) are presented in Table 1.

Example 14

Nickel expanded metal was used as the current collector, and the surface of the current collector was plasma sprayed with nickel oxide powder to coat the surface of the current collector with nickel oxide powder. Nitrogen was used as the primary gas for the plasma spraying and hydrogen was used as the secondary gas. Moreover, the hydrogen reduction treatment with respect to nickel oxide was performed to form a reverse current absorbing layer which is a porous layer. The conditions for the hydrogen reduction treatment were as follows. Hydrogen concentration: 100%, temperature: 200° C., and treatment time: 1 hour.

The evaluation on the reverse current absorption was performed. As a result, the electric quantity flowed into the reverse current absorbing layer until the electric potential of the reverse current absorbing layer reached −0.1 V (vs. Ag|AgCl) was 412,000 C/m$^2$.

Next, the evaluation on the durability of this reverse current absorbing layer was performed. The evaluation on the reverse current absorption was performed after the cycle (electrolysis and reverse electrolysis) was repeated 250 times over 1500 hours, as a result, the electric quantity flowed into the reverse current absorbing layer until the electric potential of the reverse current absorbing layer reached −0.1 V (vs. Ag|AgCl) was 318,500 C/m$^2$. In addition, the peeling of the reverse current absorbing layer was not acknowledged after the electrolysis for 1500 hours.

It has been found out that the reverse current absorbing layer of the present Example exhibits high durability as the reverse current absorption thereof has been maintained even after the electrolysis for 1500 hours. The evaluation results of the reverse current absorption, the durability, and the reverse current absorption after the electrolysis for 1500 hours (written as "reverse current absorption (after electrolysis)" in Table 1) are presented in Table 1.

In addition, the reverse current absorbing layers of Examples 11 to 14 did not cause heat generation and firing immediately after the preparation. In addition, the reverse current absorbing layer of Examples 11 to 14 did not cause heat generation and firing even when taken out into the air without applying the reverse current after the electrolysis of the aqueous solution of sodium hydroxide.

Comparative Example 11

Nickel expanded metal was used as the current collector, and the surface of the current collector was coated with Raney nickel by dispersion plating. The resultant was immersed in a 32% by weight aqueous solution of sodium hydroxide at 80° C. for 10 hours to dissolve out Al in the Raney nickel, thereby forming a reverse current absorbing layer.

The evaluation on the reverse current absorption was performed. As a result, the electric quantity flowed into the reverse current absorbing layer until the electric potential of the reverse current absorbing layer reached −0.1 V (vs. Ag|AgCl) was 137,250 C/m$^2$.

Next, the evaluation on the durability of this reverse current absorbing layer was performed. The evaluation on the reverse current absorption was performed after the cycle (electrolysis and reverse electrolysis) was repeated 8 times over 48 hours, as a result, the electric quantity flowed into the reverse current absorbing layer until the electric potential of the reverse current absorbing layer reached −0.1 V (vs. Ag|AgCl) was 4,000 C/m$^2$. In addition, the peeling of the reverse current absorbing layer was observed after the electrolysis for 48 hours. In addition, the Raney nickel generated heat and was partially red-hot when taken out into the air without applying the reverse current after the hydrogen evolution electrolysis.

In the present Comparative Example, peeling of the reverse current absorbing layer occurred already after the electrolysis for 48 hours, and thus the reverse current absorption could not be maintained. In other words, it has been found out that the reverse current absorbing layer of present Comparative Example exhibits low durability. The evaluation results of the reverse current absorption, the durability, and the reverse current absorption after the electrolysis for 48 hours (written as "reverse current absorption (after electrolysis)" in Table 1) are presented in Table 1.

[Measurement of Powder X-Ray Diffraction]

Figure 8:
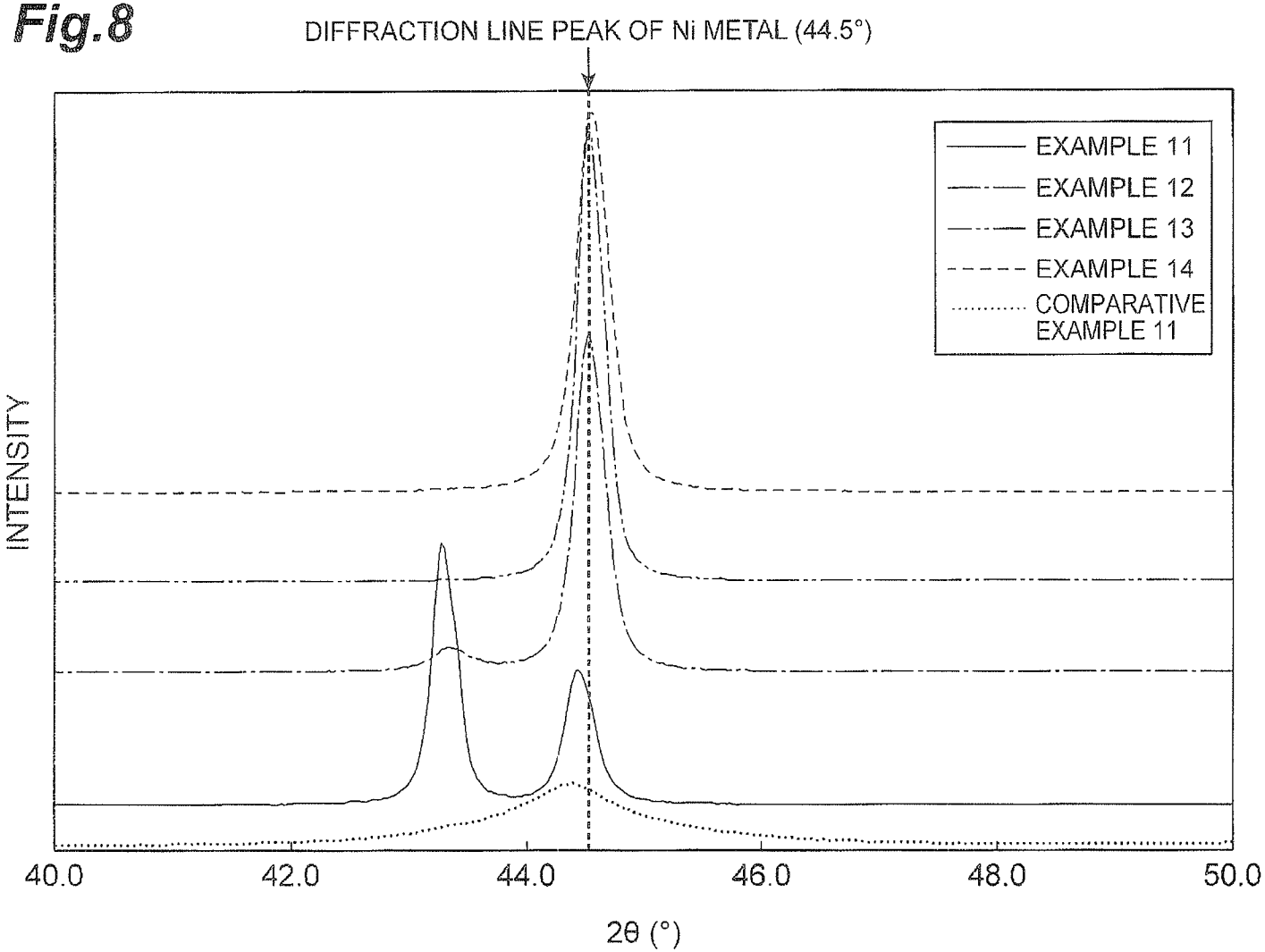
FIG. 8 is a graph illustrating powder X-ray diffraction patterns of reverse current absorbing layers in Examples and Comparative Examples.

FIG. 8 is powder X-ray diffraction patterns of the respective reverse current absorbing layers of Examples and Comparative Examples. The powder X-ray diffraction pattern was obtained from the measurement with regard to the reverse current absorbing layer which was peeled off from the current collector and processed into powder. The Raney nickel used in Comparative Example 11 generated heat and was partially red-hot when taken out into the air after being immersed in the aqueous solution of sodium hydroxide and activated. For that reason, the powder X-ray diffraction measurement of Raney nickel was performed after the heat generation has subsided.

Figure 9:
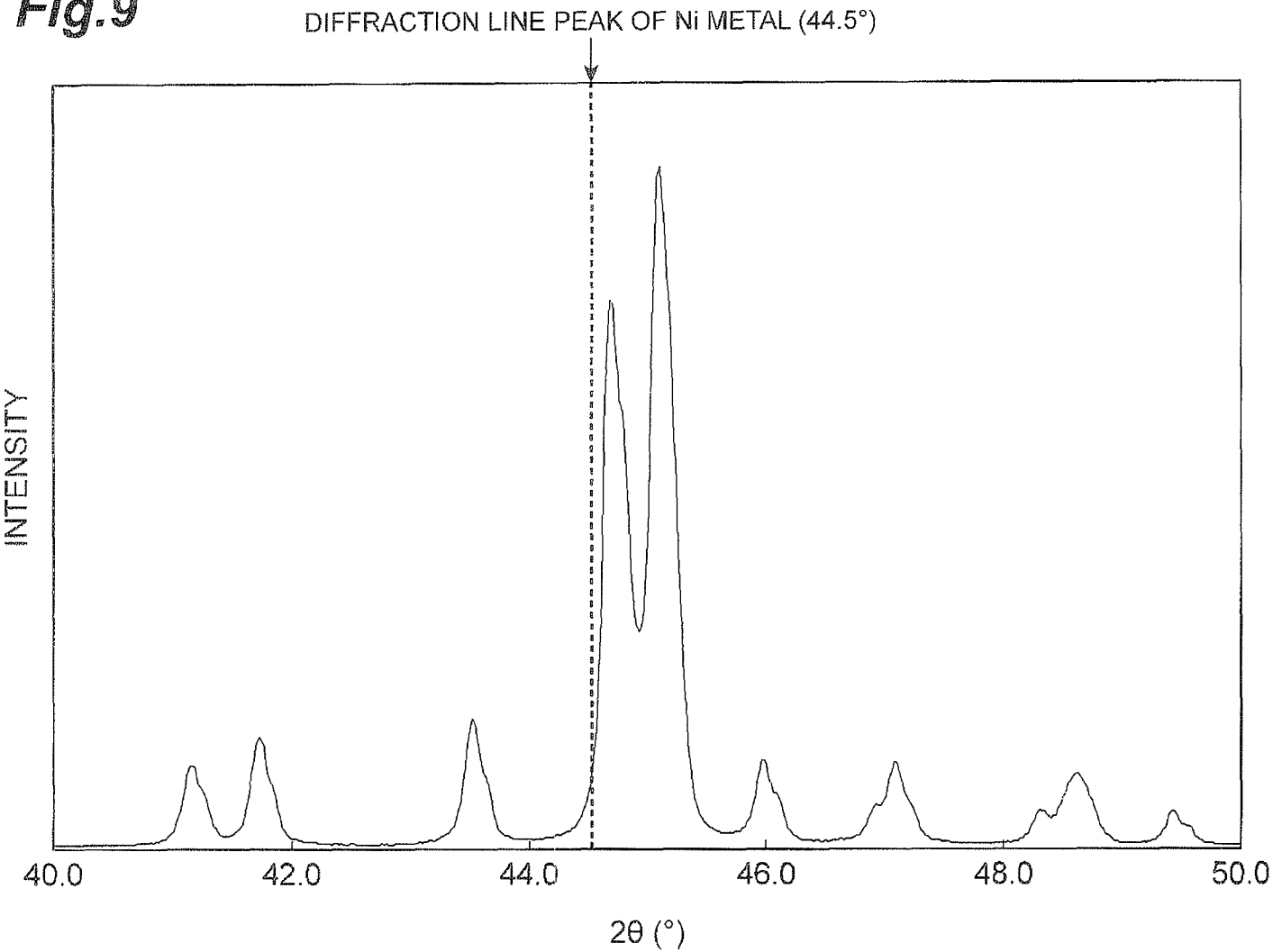
FIG. 9 is a graph illustrating a powder X-ray diffraction pattern of Raney nickel before being immersed in an aqueous solution of sodium hydroxide.

The measurement results of the full width at half maximum of the diffraction line peak of Ni metal at the diffraction angle 2θ=44.5° in the powder X-ray diffraction patterns of the samples used in Examples and Comparative Examples illustrated in FIG. 8 are presented in Table 1. In addition, the powder X-ray diffraction pattern of Raney nickel before being immersed in an aqueous solution of sodium hydroxide is illustrated in FIG. 9. The diffraction line peak of Ni metal at the diffraction angle 2θ=44.5° was not observed but the diffraction lines by the alloy of Ni and Al were observed at 2θ=41.2°, 41.8°, 43.6°, 44.9°, 45.2°, 46°, 47°, 47.1°, 48.4°, and 49.5°.

[Measurement of Specific Surface Area and Pore Characteristics]

The specific surface area, pore size distribution curve, and pore volume of the reverse current absorbing layer of Examples were measured using the "TriStar II 3020 (nitrogen gas adsorption measuring device)" manufacture by Shimadzu Corporation. The measurement results are presented in Table 1 and Table 2. These measurements were performed with regard to the reverse current absorbing layer which was peeled off from the current collector and processed into powder. Meanwhile, the Raney nickel used in Comparative Example 11 generated heat and was partially red-hot when taken out into the air after being immersed in the aqueous solution of sodium hydroxide and activated. For that reason, the measurements of the specific surface area and pore characteristics of Raney nickel were performed after the heat generation has subsided.

The specific surface area of Raney nickel is generally significantly large. For this reason, it has been estimated that the specific surface area of Raney nickel of Comparative Example 11 far exceeded 30 $m^2/g$ before being taken out into the air and generating heat. In addition, in the case of Raney nickel, it is estimated that before Raney nickel was taken out into the air and generated heat, the proportion of the pore volume of the pores having a pore size of 10 nm or greater to the total pore volume was 68.5% or less which is the value measured after the heat generation. Meanwhile, the specific surface area of Raney nickel before being immersed in an aqueous solution of sodium hydroxide was 0.4 $m^2/g$.

TABLE 1

| | Reverse current absorbing layer | | Specific surface area | Full width at half maximum | Reverse current absorption quantity | Durability Presence or absence | Reverse current absorption quantity (after electrol- |
|---|---|---|---|---|---|---|---|
| | Raw material | Forming method | ($m^2/g$) | (44.5°) | ($C/m^2$) | of peeling | ysis) ($C/m^2$) |
| Example 11 | Ni Oxide | Thermal spraying | 0.5 | 0.29 | 58000 | Absence | 519500 |
| Example 12 | Metallic Ni | Thermal spraying | 0.4 | 0.38 | 21550 | Absence | 44250 |
| Example 13 | Ni Oxide | Electrolysis after thermal spraying | 2.4 | 0.27 | 885500 | Absence | 910250 |
| Example 14 | Ni Oxide | Hydrogen reduction after thermal spraying | 3.2 | 0.34 | 412000 | Absence | 318500 |
| Comparative Example 11 | Raney Ni | Dispersion plating | 1.7 | 1.17 | 137250 | Presence | 4000 |

TABLE 2

| | Reverse current absorbing layer | | Specific surface area | Full width at half maximum | Reverse current absorption quantity | Durability Presence or absence | Reverse current absorption quantity (after electrolysis) |
|---|---|---|---|---|---|---|---|
| | Raw material | Forming method | ($m^2/g$) | (44.5°) | ($C/m^2$) | of peeling | ($C/m^2$) |
| Example 11 | Ni Oxide | Thermal spraying | 0.5 | 0.29 | 58000 | Absence | 519500 |
| Example 12 | Metallic Ni | Thermal spraying | 0.4 | 0.38 | 21550 | Absence | 44250 |
| Example 13 | Ni Oxide | Electrolysis after thermal spraying | 2.4 | 0.27 | 885500 | Absence | 910250 |
| Example 14 | Ni Oxide | Hydrogen reduction after thermal spraying | 3.2 | 0.34 | 412000 | Absence | 318500 |
| Comparative Example 11 | Raney Ni | Dispersion plating | 1.7 | 1.17 | 137250 | Presence | 4000 |

| | Reverse current absorbing layer | | Proportion of pore volume of pore having pore |
|---|---|---|---|
| | Raw material | Forming method | size of 10 nm or greater to total pore volume [%] |
| Example 11 | Ni Oxide | Thermal spraying | 85 |
| Example 12 | Metallic Ni | Thermal spraying | 83.4 |
| Example 13 | Ni Oxide | Electrolysis after thermal spraying | 91.7 |
| Example 14 | Ni Oxide | Hydrogen reduction after thermal spraying | 90.6 |
| Comparative Example 11 | Raney Ni | Dispersion plating | 68.5 |

Example 15

The influence of the reverse current on the cathode was evaluated by performing the following electrolysis experiment using a current collector having a reverse current absorbing layer formed thereon in the same manner as in Example 13. The electrolysis cell was fabricated with a transparent acrylic material in order to observe the inside of the cathode chamber of the electrolysis cell from the outside. The anode cell having an anode chamber installed with an anode (anode terminal cell) and the cathode cell having a cathode chamber installed with the cathode (cathode terminal cell) were combined to face each other. A pair of gaskets was disposed between the cells, and an ion exchange membrane was sandwiched between the pair of gaskets. Then, the anode cell, the gasket, the ion exchange membrane, the gasket, and the cathode were tightly attached to obtain an electrolysis cell.

As the anode, the so-called DSA (registered trademark) in which an oxide having ruthenium, iridium and titanium as a component was formed on a titanium substrate was used. As the cathode, a nickel plain weave wire mesh coated with ruthenium oxide and cerium oxide was used. The four sides of the cathode cut into a size of 95 mm in length×110 mm in width were bent at a right angle by about 2 mm. As the current collector, a current collector having a reverse current absorbing layer formed thereon in the same manner as in Example 13 was used. The size of the current collector was 95 mm in length×110 mm in width. As the metal elastic body, a mat woven with a nickel thin wire was used. The mat of the metal elastic body was placed on the current collector. The cathode was covered on the current collector in a state where the bent portion of the cathode was toward the current collector. Then, the four corners of the cathode were fixed to the collector with a string fabricated with Teflon (registered trademark). As the gasket, an EPDM (ethylene propylene diene) rubber gasket was used. As the ion exchange membrane, the "Aciplex" (registered trademark) F6801 (manufactured by Asahi Kasei Chemicals Corporation) was used.

The electrolysis of salt was performed using the electrolysis cell described above. The concentration of salt water (concentration of sodium chloride) in the anode chamber was adjusted to 205 g/L. The concentration of sodium hydroxide in the cathode chamber was adjusted to 32% by weight. The temperature of each of the anode chamber and the cathode chamber was adjusted such that the temperature inside each of the electrolysis cells was 90° C.

The electrolysis of salt was performed for 2 hours at a current density of 6 kA/$m^2$ and then the current density was dropped to 0 kA/$m^2$ at once. Thereafter, the plus and the minus of the rectifier terminals were switched and the electric current in the direction opposite to the electrolysis (reverse current) was applied to the electrolysis cell. The current density of the reverse current was set to 250 A/$m^2$. The electric potential of the cathode with respect to the Ag|AgCl reference electrode was measured using the Luggin tube introduced into the cathode chamber while the reverse current was flowing.

It took 2409 seconds from when the reverse current started to flow to when the electric potential of the cathode reached −0.2 V (vs. Ag|AgCl). At this time, the dissolution of Ru from the catalytic layer was not observed in the cathode chamber. Meanwhile, the electric potential at which Ru starts to dissolve out is −0.1 V (vs. Ag|AgCl). The electric quantity of the reverse current flowed during the 2409 seconds was 602,250 C/$m^2$ per one electrolysis cell. In addition, the peeling of the reverse current absorbing body was not observed even at the part in contact with the mat of the metal elastic body.

Comparative Example 12

The electrolysis cell of Comparative Example 12 the same as that of Example 15 except not equipped with a reverse current absorbing layer was manufactured. The electrolysis experiment was performed using the electrolysis cell of Comparative Example 12 in the same manner as in Example 15 except setting the current density of the reverse current to 50 A/$m^2$.

As a result, it took 450 seconds from when the reverse current started to flow to when the electric potential of the cathode reached −0.2 V (vs. Ag|AgCl). The electric quantity of the reverse current flowed during the 450 seconds was 22,500 C/$m^2$ per one electrolysis cell.

From the results above, it has been found out that the electrolysis cell of Example 15 equipped with a reverse current absorbing layer can absorb a significantly large quantity of reverse current compared to the electrolysis cell of Comparative Example 12 not having a reverse current absorbing layer.

INDUSTRIAL APPLICABILITY

The electrolysis cell and electrolysis tank according to the invention can suppress the degradation of the cathode by the reverse current even without applying a protection current at the time of stopping electrolysis and is simply operated in terms of not requiring the protection current. In addition, it is also possible to prevent a reverse current absorbing body from firing in the invention. For that reason, the electrolysis cell and electrolysis tank according to the invention are suitable for the electrolysis of salt water, an aqueous solution of an alkali metal salt, or the like, the water electrolysis, a fuel cell, or the like.

REFERENCE SIGNS LIST

1 . . . Electrolysis cell, 2 . . . Ion exchange membrane, 4 . . . electrolysis tank, 5 . . . Press machine, 6 . . . Cathode terminal, 7 . . . Anode terminal, 10 . . . Anode chamber, 11 . . . Anode, 18 . . . Reverse current absorbing body, 18*a* . . . Substrate, 18*b* . . . Reverse current absorbing layer, 19 . . . Bottom of anode chamber, 20 . . . Cathode chamber, 21 . . . Cathode, 22 . . . Metal elastic body, 23 . . . Current collector, 24 . . . Support, 30 . . . Partition wall, 40 . . . Cathode structure for electrolysis.

The invention claimed is:

1. An electrolysis cell comprising:
an anode chamber;
a cathode chamber;
a partition wall separating the anode chamber from the cathode chamber;
an anode installed in the anode chamber;
a cathode installed in the cathode chamber; and
a reverse current absorbing body having a substrate and a reverse current absorbing layer formed on the substrate and installed in the cathode chamber,
wherein the anode and the cathode are electrically connected and the cathode and the reverse current absorbing layer are electrically connected, and
wherein the reverse current absorbing layer is a porous layer including Ni or NiO, and a full width at half maximum of a diffraction line peak of Ni metal at a diffraction angle 2θ=44.5° in a powder X-ray diffraction pattern of the reverse current absorbing layer is 0.6° or less.

2. The electrolysis cell according to claim 1, wherein the reverse current absorbing layer includes an element having an oxidation-reduction potential lower than the cathode.

3. The electrolysis cell according to claim 1, wherein the reverse current absorbing layer includes one or more kinds of elements selected from the group consisting of C, Cr, Ni, Ti, Fe, Co, Cu, Al, Zr, Ru, Rh, Pd, Ag, W, Re, Os, Ir, Pt, Au, Bi, Cd, Hg, Mn, Mo, Sn, Zn, La, Ce, Pr, Nd, Pm, Sm, Eu, Gd, Tb, Dy, Ho, Er, Tm, Yb, and Lu.

4. The electrolysis cell according to any one of claims 1 to 3, wherein a pore volume of a pore having a pore size of 10 nm or greater is 80% or more of a total pore volume in a pore size distribution curve of the reverse current absorbing layer measured by a nitrogen gas adsorption method.

5. The electrolysis cell according to any one of claims 1 to 3, wherein the reverse current absorbing layer is formed by thermal spraying Ni or NiO on at least a part of a surface of the substrate.

6. The electrolysis cell according to claim 5, wherein the reverse current absorbing layer is formed by thermal spraying NiO on at least a part of a surface of the substrate and then performing a reduction treatment to the NiO.

7. The electrolysis cell according to any one of claims 1 to 3, wherein the cathode has a Ni substrate and a catalytic layer formed on the Ni substrate.

8. The electrolysis cell according to any one of claims 1 to 3, wherein the cathode chamber further has a current collector, a support supporting the current collector, and a metal elastic body, the metal elastic body is disposed between the current collector and the cathode, the support is disposed between the current collector and the partition wall, and the partition wall, the support, the current collector, the metal elastic body, and the cathode are electrically connected.

9. The electrolysis cell according to claim 8, wherein at least a part of the substrate of the reverse current absorbing body is the current collector, and the reverse current absorbing layer is formed on a surface of the current collector.

10. The electrolysis cell according to claim 8, wherein at least a part of the substrate of the reverse current absorbing body is the metal elastic body, and the reverse current absorbing layer is formed on a surface of the metal elastic body.

11. The electrolysis cell according to claim 8, wherein at least a part of the substrate of the reverse current absorbing body is the partition wall, and the reverse current absorbing layer is formed on a surface of the partition wall.

12. The electrolysis cell according to claim 8, wherein at least a part of the substrate of the reverse current absorbing body is the support, and the reverse current absorbing layer is formed on a surface of the support.

13. The electrolysis cell according to claim 8, wherein at least a part of the reverse current absorbing body is disposed between the cathode and the metal elastic body.

14. The electrolysis cell according to claim 8, wherein at least a part of the reverse current absorbing body is disposed between the metal elastic body and the current collector.

15. The electrolysis cell according to claim 8, wherein at least a part of the reverse current absorbing body is disposed between the current collector and the partition wall.

16. The electrolysis cell according to any one of claims 1 to 3, wherein the cathode chamber further has a support supporting the cathode, the support is disposed between the cathode and the partition wall, and the partition wall, the support, and the cathode are electrically connected.

17. The electrolysis cell according to claim 16, wherein at least a part of the substrate of the reverse current absorbing body is the partition wall, and the reverse current absorbing layer is formed on a surface of the partition wall.

18. The electrolysis cell according to claim 17, wherein at least a part of the substrate of the reverse current absorbing body is the support, and the reverse current absorbing layer is formed on a surface of the support.

19. The electrolysis cell according to claim 18, wherein the reverse current absorbing body is disposed between the cathode and the partition wall.

20. The electrolysis cell according to claim 17, wherein the reverse current absorbing body is disposed between the cathode and the partition wall.

21. The electrolysis cell according to claim 16, wherein at least a part of the substrate of the reverse current absorbing body is the support, and the reverse current absorbing layer is formed on a surface of the support.

22. The electrolysis cell according to claim 21, wherein the reverse current absorbing body is disposed between the cathode and the partition wall.

23. The electrolysis cell according to claim 16, wherein the reverse current absorbing body is disposed between the cathode and the partition wall.

24. The electrolysis cell according to any one of claims 1 to 3, wherein at least a part of the substrate of the reverse current absorbing body is a cube, a cuboid, a plate shape, a rod shape, a reticular shape, or a spherical shape.

25. The electrolysis cell according to any one of claims 1 to 3, wherein a specific surface area of the reverse current absorbing layer is from 0.01 to 100 $m^2/g$.

26. The electrolysis cell according to any one of claims 1 to 3, wherein a sum of electric quantities absorbed by all of the reverse current absorbing bodies is from 1,000 to 2,000,000 $C/m^2$.

27. The electrolysis cell according to any one of claims 1 to 3, wherein a sum of effective surface areas of all of the reverse current absorbing bodies is from 10 to 100,000 $m^2$.

28. An electrolysis tank comprising the electrolysis cell according to any one of claims 1 to 3.

29. The electrolysis cell according to claim 2, wherein the reverse current absorbing layer includes one or more kinds of elements selected from the group consisting of C, Cr, Ni, Ti, Fe, Co, Cu, Al, Zr, Ru, Rh, Pd, Ag, W, Re, Os, Ir, Pt, Au, Bi, Cd, Hg, Mn, Mo, Sn, Zn, La, Ce, Pr, Nd, Pm, Sm, Eu, Gd, Tb, Dy, Ho, Er, Tm, Yb, and Lu.

30. The electrolysis cell according to claim 29, wherein a pore volume of a pore having a pore size of 10 nm or greater is 80% or more of a total pore volume in a pore size distribution curve of the reverse current absorbing layer measured by a nitrogen gas adsorption method.

31. The electrolysis cell according to claim 29, wherein the reverse current absorbing layer is formed by thermal spraying Ni or NiO on at least a part of a surface of the substrate.

32. The electrolysis cell according to claim 29, wherein the reverse current absorbing layer is formed by thermal spraying NiO on at least a part of a surface of the substrate and then performing a reduction treatment to the NiO.

33. The electrolysis cell according to claim 29, wherein the cathode has a Ni substrate and a catalytic layer formed on the Ni substrate.

34. The electrolysis cell according to claim 29, wherein the cathode chamber further has a current collector, a support supporting the current collector, and a metal elastic body, the metal elastic body is disposed between the current collector and the cathode, the support is disposed between the current collector and the partition wall, and the partition wall, the support, the current collector, the metal elastic body, and the cathode are electrically connected.

35. The electrolysis cell according to claim 34, wherein at least a part of the substrate of the reverse current absorbing body is the current collector, and the reverse current absorbing layer is formed on a surface of the current collector.

36. The electrolysis cell according to claim 34, wherein at least a part of the substrate of the reverse current absorbing body is the metal elastic body, and the reverse current absorbing layer is formed on a surface of the metal elastic body.

37. The electrolysis cell according to claim 34, wherein at least a part of the substrate of the reverse current absorbing body is the partition wall, and the reverse current absorbing layer is formed on a surface of the partition wall.

38. The electrolysis cell according to claim 34, wherein at least a part of the substrate of the reverse current absorbing body is the support, and the reverse current absorbing layer is formed on a surface of the support.

39. The electrolysis cell according to claim 34, wherein at least a part of the reverse current absorbing body is disposed between the cathode and the metal elastic body.

40. The electrolysis cell according to claim 34, wherein at least a part of the reverse current absorbing body is disposed between the metal elastic body and the current collector.

41. The electrolysis cell according to claim 34, wherein at least a part of the reverse current absorbing body is disposed between the current collector and the partition wall.

42. The electrolysis cell according to claim 29, wherein the cathode chamber further has a support supporting the cathode, the support is disposed between the cathode and the partition wall, and the partition wall, the support, and the cathode are electrically connected.

43. The electrolysis cell according to claim 42, wherein at least a part of the substrate of the reverse current absorbing body is the partition wall, and the reverse current absorbing layer is formed on a surface of the partition wall.

44. The electrolysis cell according to claim 43, wherein at least a part of the substrate of the reverse current absorbing body is the support, and the reverse current absorbing layer is formed on a surface of the support.

45. The electrolysis cell according to claim 44, wherein the reverse current absorbing body is disposed between the cathode and the partition wall.

46. The electrolysis cell according to claim 43, wherein the reverse current absorbing body is disposed between the cathode and the partition wall.

47. The electrolysis cell according to claim 42, wherein at least a part of the substrate of the reverse current absorbing body is the support, and the reverse current absorbing layer is formed on a surface of the support.

48. The electrolysis cell according to claim 47, wherein the reverse current absorbing body is disposed between the cathode and the partition wall.

49. The electrolysis cell according to claim 42, wherein the reverse current absorbing body is disposed between the cathode and the partition wall.

50. The electrolysis cell according to claim 29, wherein at least a part of the substrate of the reverse current absorbing body is a cube, a cuboid, a plate shape, a rod shape, a reticular shape, or a spherical shape.

51. The electrolysis cell according to claim 29, wherein a specific surface area of the reverse current absorbing layer is from 0.01 to 100 $m^2/g$.

52. The electrolysis cell according to claim 29, wherein a sum of electric quantities absorbed by all of the reverse current absorbing bodies is from 1,000 to 2,000,000 $C/m^2$.

53. The electrolysis cell according to claim 29, wherein a sum of effective surface areas of all of the reverse current absorbing bodies is from 10 to 100,000 $m^2$.

54. An electrolysis tank comprising the electrolysis cell according to claim 29.

* * * * *